US011113923B2

(12) United States Patent
Chun

(10) Patent No.: US 11,113,923 B2
(45) **Date of Patent: *Sep. 7, 2021**

(54) GAMING TABLE SYSTEMS FOR OVERLAPPING GAME PLAY

(71) Applicant: Fresh Idea Global Limited, Hong Kong (HK)

(72) Inventor: Jay Chun, Hong Kong (HK)

(73) Assignee: Fresh Idea Global Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 16/735,685

(22) Filed: Jan. 6, 2020

(65) Prior Publication Data

US 2020/0143627 A1 May 7, 2020

Related U.S. Application Data

(63) Continuation of application No. 14/929,240, filed on Oct. 30, 2015, now Pat. No. 10,529,168.

(51) Int. Cl.
*G07F 17/32* (2006.01)

(52) U.S. Cl.
CPC ..... *G07F 17/3204* (2013.01); *G07F 17/322* (2013.01); *G07F 17/3218* (2013.01); (Continued)

(58) Field of Classification Search
CPC ..... G07F 17/3276; G07F 17/3293
See application file for complete search history.

(56) References Cited

U.S. PATENT DOCUMENTS

| | | | |
|---|---|---|---|
| 629,672 | A | 7/1899 | Fadum |
| D72,257 | S | 3/1927 | Haunz |

(Continued)

FOREIGN PATENT DOCUMENTS

| | | |
|---|---|---|
| CN | 101244335 | 8/2008 |
| CN | 101513571 | 8/2009 |

(Continued)

OTHER PUBLICATIONS

Office Action for U.S. Appl. No. 13/948,101, dated Dec. 16, 2013.

(Continued)

*Primary Examiner* — Steven J Hylinski

(57) ABSTRACT

Gaming table systems can include multiple electronic gaming tables, multiple gaming terminals, and a system server. Each gaming terminal can have a terminal controller adapted to facilitate the overlapping or simultaneous play by a single player of multiple wager-based table games at multiple electronic gaming tables. A server in communication with the gaming tables controls starting times of the wager-based table games by sending signals to the tables indicating when each game is allowed to start. Signals can be sent due to triggering events and/or can cause staggered starting times across games, which can allow faster players to play more games. The server can also control which gaming tables starts a next game, distribute table usage, and confirm that wagers are placed within a proper time frame for their respective games. A compliance server can verify eligibility of remote gaming terminals to participate in wager-based game play in the system.

14 Claims, 12 Drawing Sheets

(52) U.S. Cl.
CPC ..... *G07F 17/3223* (2013.01); *G07F 17/3225* (2013.01); *G07F 17/3244* (2013.01); *G07F 17/3269* (2013.01); *G07F 17/3272* (2013.01); *G07F 17/3276* (2013.01); *G07F 17/3293* (2013.01)

(56) References Cited

U.S. PATENT DOCUMENTS

| | | | |
|---|---|---|---|
| 2,302,333 | A | 11/1942 | Linke |
| D141,237 | S | 5/1945 | Gauvreau |
| D150,824 | S | 9/1948 | Buckner |
| D170,040 | S | 7/1953 | Altemiller |
| D246,916 | S | 1/1978 | Cheng |
| D259,847 | S | 7/1981 | Hamby |
| D268,368 | S | 3/1983 | Moss |
| D280,477 | S | 9/1985 | Petrick |
| 4,856,787 | A | 8/1989 | Itkis |
| D321,614 | S | 11/1991 | Liptak |
| 5,083,271 | A | 1/1992 | Thacher et al. |
| 5,347,061 | A | 9/1994 | Harandi et al. |
| 5,472,194 | A | 12/1995 | Breeding et al. |
| 5,605,334 | A | 2/1997 | McCrea |
| 5,707,061 | A | 1/1998 | Ikeda |
| 5,762,552 | A | 6/1998 | Vuong |
| 5,768,382 | A | 6/1998 | Schneier et al. |
| 5,823,873 | A | 10/1998 | Moody |
| 5,851,011 | A | 12/1998 | Lott |
| 5,917,725 | A | 6/1999 | Thacher et al. |
| 5,970,143 | A | 10/1999 | Schneier et al. |
| 6,165,069 | A | 12/2000 | Sines et al. |
| D438,260 | S | 2/2001 | Isetani |
| D438,404 | S | 3/2001 | Topper |
| 6,331,148 | B1 | 12/2001 | Krause |
| 6,361,044 | B1 | 3/2002 | Block |
| 6,394,901 | B1 | 5/2002 | Marta |
| 6,508,709 | B1 | 1/2003 | Karmarkar |
| 6,652,378 | B2 | 11/2003 | Cannon |
| 6,671,358 | B1 | 12/2003 | Seidman et al. |
| 6,886,829 | B2 | 5/2005 | Hessing et al. |
| 6,991,544 | B2 | 1/2006 | Soltys et al. |
| 7,008,322 | B1 | 3/2006 | Suzuki et al. |
| 7,040,982 | B1 | 5/2006 | Jarvis |
| D539,854 | S | 4/2007 | Luciano |
| 7,206,762 | B2 | 4/2007 | Sireau |
| 7,233,922 | B2 | 6/2007 | Asher |
| D546,596 | S | 7/2007 | McDermott et al. |
| D557,348 | S | 12/2007 | Gutknecht |
| 7,553,233 | B2 | 6/2009 | Jarvis et al. |
| D596,678 | S | 7/2009 | Myers |
| 7,566,268 | B2 | 7/2009 | Asher |
| 7,566,270 | B2 | 7/2009 | Amaitis |
| 7,604,537 | B2 | 10/2009 | Amaitis |
| 7,637,506 | B2 | 12/2009 | Naicker |
| 7,684,874 | B2 | 3/2010 | Schlottmann et al. |
| 7,690,996 | B2 | 4/2010 | Iddings et al. |
| D615,319 | S | 5/2010 | Tuszkiewicz |
| 7,711,628 | B2 | 5/2010 | Davie |
| 7,727,060 | B2 | 6/2010 | Mills |
| 7,731,586 | B2 | 6/2010 | Letovsky et al. |
| 7,783,542 | B2 | 8/2010 | Horowitz |
| 7,783,552 | B2 | 8/2010 | Assia |
| 7,798,895 | B2 | 9/2010 | Jubinville et al. |
| D641,427 | S | 7/2011 | Lin |
| D645,910 | S | 9/2011 | Foster |
| 8,052,526 | B2 | 11/2011 | Abbott et al. |
| 8,070,583 | B2 | 12/2011 | Baerlocher et al. |
| 8,150,157 | B2 | 4/2012 | Downs et al. |
| 8,257,166 | B2 | 9/2012 | Kido |
| 8,262,090 | B2 | 9/2012 | Soltys et al. |
| 8,272,892 | B2 | 9/2012 | McNeely et al. |
| 8,282,489 | B2 | 10/2012 | Azerina et al. |
| 8,348,278 | B2 | 1/2013 | Tseng |
| 8,444,148 | B1 | 5/2013 | Tseng |
| 8,469,788 | B2 | 6/2013 | Carpenter et al. |
| 8,590,895 | B2 | 11/2013 | Kwon |
| 8,684,830 | B1 | 4/2014 | Chun |
| 8,808,077 | B1 | 8/2014 | Chun |
| 8,920,229 | B1 | 12/2014 | Chun |
| 9,292,996 | B2 | 3/2016 | Davis et al. |
| 9,311,773 | B2 | 4/2016 | Chung |
| 9,449,461 | B1 | 9/2016 | Barksdale |
| 9,592,450 | B2 | 3/2017 | Chun |
| 9,595,166 | B2 | 3/2017 | Chun |
| 9,779,580 | B2 | 10/2017 | Jones |
| 9,858,752 | B2 | 1/2018 | Montgomery |
| 9,931,562 | B2 | 4/2018 | Chun |
| 9,940,782 | B2 | 4/2018 | Chun |
| RE46,826 | E | 5/2018 | Hill |
| 10,013,847 | B2 | 7/2018 | Chun |
| 10,147,269 | B2 | 12/2018 | Chun |
| D852,890 | S | 7/2019 | Ross |
| 2002/0002073 | A1 | 1/2002 | Montgomery |
| 2002/0094869 | A1 | 7/2002 | Harkham |
| 2002/0147042 | A1 | 10/2002 | Shinners et al. |
| 2002/0151366 | A1 | 10/2002 | Walker et al. |
| 2003/0070178 | A1 | 4/2003 | Boyd |
| 2003/0137110 | A1 | 7/2003 | Huard et al. |
| 2003/0195841 | A1 | 10/2003 | Ginsberg |
| 2004/0121839 | A1 | 6/2004 | Web |
| 2004/0152498 | A1 | 8/2004 | Kaminkow |
| 2004/0204232 | A1 | 10/2004 | Asher |
| 2005/0043094 | A1 | 2/2005 | Nguyen et al. |
| 2005/0165669 | A1 | 7/2005 | Montanaro |
| 2005/0197938 | A1 | 9/2005 | Davie |
| 2005/0197948 | A1 | 9/2005 | Davie |
| 2006/0025221 | A1 | 2/2006 | Jain |
| 2006/0058082 | A1 | 3/2006 | Crawford et al. |
| 2006/0058083 | A1 | 3/2006 | Crawford et al. |
| 2006/0058084 | A1 | 3/2006 | Crawford et al. |
| 2006/0058085 | A1 | 3/2006 | White et al. |
| 2006/0058086 | A1 | 3/2006 | White et al. |
| 2006/0058087 | A1 | 3/2006 | White et al. |
| 2006/0058088 | A1 | 3/2006 | Crawford et al. |
| 2006/0058089 | A1 | 3/2006 | White et al. |
| 2006/0058090 | A1 | 3/2006 | Crawford et al. |
| 2006/0058091 | A1 | 3/2006 | Crawford et al. |
| 2006/0058092 | A1 | 3/2006 | Crawford et al. |
| 2006/0058093 | A1 | 3/2006 | White et al. |
| 2006/0066052 | A1 | 3/2006 | White et al. |
| 2006/0068498 | A1 | 3/2006 | White et al. |
| 2006/0068864 | A1 | 3/2006 | White et al. |
| 2006/0068865 | A1 | 3/2006 | White et al. |
| 2006/0068866 | A1 | 3/2006 | White et al. |
| 2006/0068868 | A1 | 3/2006 | Crawford et al. |
| 2006/0068869 | A1 | 3/2006 | White et al. |
| 2006/0068870 | A1 | 3/2006 | Crawford et al. |
| 2006/0068871 | A1 | 3/2006 | Crawford et al. |
| 2006/0068879 | A1 | 3/2006 | Crawford et al. |
| 2006/0068899 | A1 | 3/2006 | White et al. |
| 2006/0094493 | A1 | 5/2006 | Kido |
| 2006/0100019 | A1 | 5/2006 | Hornik et al. |
| 2006/0105839 | A1 | 5/2006 | Graeve |
| 2006/0217199 | A1 | 9/2006 | Adcox et al. |
| 2006/0264252 | A1 | 11/2006 | White et al. |
| 2006/0287066 | A1 | 12/2006 | Crawford et al. |
| 2006/0287067 | A1 | 12/2006 | White et al. |
| 2006/0287097 | A1 | 12/2006 | Moshal |
| 2006/0287101 | A1 | 12/2006 | Crawford et al. |
| 2006/0287102 | A1 | 12/2006 | White et al. |
| 2006/0287103 | A1 | 12/2006 | Crawford et al. |
| 2006/0287104 | A1 | 12/2006 | White et al. |
| 2007/0015583 | A1 | 1/2007 | Tran |
| 2007/0032283 | A1 | 2/2007 | Chun |
| 2007/0060259 | A1 | 3/2007 | Pececnik |
| 2007/0087832 | A1 | 4/2007 | Abbott et al. |
| 2007/0090595 | A1 | 4/2007 | Csikos |
| 2007/0129138 | A1 | 6/2007 | Amaitis |
| 2007/0178955 | A1 | 8/2007 | Mills |
| 2007/0259709 | A1 | 11/2007 | Kelly et al. |
| 2008/0045344 | A1 | 2/2008 | Schlottmann et al. |
| 2008/0081685 | A1 | 4/2008 | Naftaly |
| 2008/0102916 | A1 | 5/2008 | Kovacs |
| 2008/0108404 | A1 | 5/2008 | Iddings et al. |
| 2008/0108436 | A1 | 5/2008 | Oberberger |

(56) References Cited

U.S. PATENT DOCUMENTS

| | | | | |
|---|---|---|---|---|
| 2008/0113767 | A1 | 5/2008 | Nguyen et al. | |
| 2008/0153571 | A1 | 6/2008 | Okada | |
| 2008/0200242 | A1 | 8/2008 | Ginsberg | |
| 2008/0220837 | A1 | 9/2008 | Yoshizawa | |
| 2008/0248849 | A1 | 10/2008 | Lutnick et al. | |
| 2008/0248864 | A1 | 10/2008 | Toyoda | |
| 2008/0318651 | A1 | 12/2008 | Gross | |
| 2009/0005165 | A1 | 1/2009 | Arezina | |
| 2009/0121434 | A1 | 5/2009 | Baerlocher | |
| 2009/0124323 | A1 | 5/2009 | Dunn et al. | |
| 2009/0131151 | A1 | 5/2009 | Harris et al. | |
| 2009/0189351 | A1* | 7/2009 | Baerlocher | G07F 17/3211 273/309 |
| 2009/0197676 | A1* | 8/2009 | Baerlocher | G07F 17/3211 463/30 |
| 2009/0275376 | A1 | 11/2009 | Anderson | |
| 2009/0280904 | A1 | 11/2009 | Nicely et al. | |
| 2009/0291762 | A1 | 11/2009 | Walter | |
| 2009/0325686 | A1 | 12/2009 | Davis et al. | |
| 2010/0087241 | A1 | 4/2010 | Nguyen et al. | |
| 2010/0150460 | A1 | 4/2010 | Makhoul et al. | |
| 2010/0234089 | A1 | 9/2010 | Saffari | |
| 2010/0234099 | A1 | 9/2010 | Rasmussen | |
| 2010/0331085 | A1 | 12/2010 | Nagano | |
| 2011/0018194 | A1 | 1/2011 | Nicely et al. | |
| 2011/0111833 | A1 | 5/2011 | Nordahl | |
| 2011/0294561 | A1 | 12/2011 | Shaw et al. | |
| 2011/0300917 | A1 | 12/2011 | Hill | |
| 2012/0049447 | A1 | 3/2012 | Klein | |
| 2012/0049455 | A1 | 3/2012 | Yap et al. | |
| 2012/0083909 | A1 | 4/2012 | Carpenter et al. | |
| 2012/0122564 | A1 | 5/2012 | Kovacs | |
| 2012/0214575 | A1 | 8/2012 | Amaitis et al. | |
| 2012/0252564 | A1 | 10/2012 | Moore et al. | |
| 2012/0264496 | A1* | 10/2012 | Behrman | A63F 1/18 463/11 |
| 2012/0329551 | A1 | 12/2012 | Arerina et al. | |
| 2013/0005456 | A1 | 1/2013 | Okujo et al. | |
| 2013/0079147 | A1 | 3/2013 | Merati | |
| 2013/0116031 | A1 | 5/2013 | Carpenter et al. | |
| 2013/0134672 | A1 | 5/2013 | Okuaki | |
| 2013/0225276 | A1 | 8/2013 | Au-Yeung | |
| 2013/0244765 | A1 | 9/2013 | Arnone et al. | |
| 2013/0260863 | A1 | 10/2013 | Lee | |
| 2013/0281197 | A1 | 10/2013 | Carpenter et al. | |
| 2013/0288764 | A1 | 10/2013 | Chun | |
| 2013/0288779 | A1 | 10/2013 | Chun | |
| 2013/0296031 | A1 | 11/2013 | Arnone et al. | |
| 2013/0341862 | A1 | 12/2013 | Tokue | |
| 2014/0094256 | A1* | 4/2014 | Hilbert | G07F 17/3211 463/20 |
| 2014/0094298 | A1* | 4/2014 | Lyons | G07F 17/3204 463/31 |
| 2014/0187306 | A1 | 7/2014 | Nordahl | |
| 2014/0256392 | A1 | 9/2014 | Jones | |
| 2014/0256411 | A1 | 9/2014 | Basallo | |
| 2014/0274252 | A1 | 9/2014 | Chun | |
| 2014/0274253 | A1 | 9/2014 | Chun | |
| 2014/0312567 | A1 | 10/2014 | Chun | |
| 2015/0019744 | A1 | 1/2015 | Bourenkov | |
| 2015/0024818 | A1 | 1/2015 | Chun | |
| 2015/0116410 | A1 | 4/2015 | Armbruster et al. | |
| 2015/0161851 | A1 | 6/2015 | Naicker | |
| 2015/0332552 | A1 | 11/2015 | Chun | |
| 2016/0292954 | A1 | 10/2016 | Sugai et al. | |
| 2017/0161988 | A1 | 6/2017 | Nguyen | |
| 2017/0161993 | A1 | 6/2017 | Nguyen | |
| 2018/0315272 | A1 | 11/2018 | Chun | |

FOREIGN PATENT DOCUMENTS

| | | | |
|---|---|---|---|
| CN | 102580306 | | 7/2012 |
| EP | 1939826 | A2 | 7/2008 |
| TW | 201138907 | A1 | 11/2011 |

OTHER PUBLICATIONS

Cantor Fitzgerald Hopes to Bring Spread Betting to Las Vegas Casinos, Dec. 14, 2009.
Financial Spread Betting, Apr. 26, 2012.
High-Speed Traders Set Their Sights on Asia and Latin America, Aug. 12, 2010.
Office Action for U.S. Appl. No. 13/456,110, dated Jun. 11, 2013.
Final Office Action for U.S. Appl. No. 13/456,110, dated Dec. 24, 2013.
Office Action for U.S. Appl. No. 14/017,071, dated Nov. 7, 2013.
Notice of Allowance for U.S. Appl. No. 14/017,071, dated Jan. 24, 2014.
Office Action for U.S. Appl. No. 14/017,073, dated Dec. 10, 2013.
Final Office Action for U.S. Appl. No. 13/948,101, dated Apr. 23, 2014.
Notice of Allowance for U.S. Appl. No. 14/017,073, dated May 20, 2014.
Office Action for U.S. Appl. No. 14/095,882, dated Aug. 14, 2014.
Office Action for U.S. Appl. No. 13/456,110, dated Sep. 12, 2014.
Office Action for U.S. Appl. No. 13/542,446, dated Sep. 10, 2014.
Office Action for U.S. Appl. No. 14/197,683, dated Aug. 4, 2014.
Office Action for U.S. Appl. No. 14/174,701, dated Mar. 12, 2015.
Final Office Action for U.S. Appl. No. 13/542,446, dated Mar. 25, 2015.
Final Office Action for U.S. Appl. No. 13/456,110, dated Apr. 22, 2015.
Office Action for U.S. Appl. No. 13/456,110, dated Jan. 13, 2016.
Final Office Action for U.S. Appl. No. 13/542,446, dated Jan. 4, 2016.
Office Action for U.S. Appl. No. 15/094,827, dated Sep. 22, 2016.
Notice of Allowance for U.S. Appl. No. 13/456,110, dated Nov. 16, 2016.
Notice of Allowance for U.S. Appl. No. 13/542,446, dated Nov. 16, 2016.
Office Action for U.S. Appl. No. 14/692,623, dated Oct. 5, 2016.
Office Action for U.S. Appl. No. 14/318,426, dated Sep. 11, 2015.
Notice of Allowance for U.S. Appl. No. 14/318,426, dated Dec. 8, 2015.
Office Action for U.S. Appl. No. 14/508,922, dated Jan. 30, 2017.
Final Office Action for U.S. Appl. No. 14/692,623, dated Mar. 24, 2017.
Notice of Allowance for U.S. Appl. No. 14/692,623, dated Jun. 30, 2017.
Restriction Requirement for U.S. Appl. No. 14/692,623, dated Sep. 6, 2016.
Office Action for U.S. Appl. No. 15/094,827, dated Sep. 13, 2017.
SIPO of People's Republic of China, Examiner's Report and International Search Report for Macau Patent Application No. I-1385 dated May 26, 2017(with partial Translation).
Notice of Allowance for U.S. Appl. No. 14/692,623, dated Nov. 29, 2017.
Final Office Action for U.S. Appl. No. 15/441,182, dated Mar. 16, 2018.
Notice of Allowance for U.S. Appl. No. 15/094,827, dated Apr. 4, 2018.
Notice of Allowance for U.S. Appl. No. 15/691,738, dated May 23, 2018.
Office Action for U.S. Appl. No. 14/929,240, dated Jun. 1, 2018.
Office Action for U.S. Appl. No. 15/231,693, dated Jun. 22, 2018.
Office Action for U.S. Appl. No. 15/943,661, dated Jun. 29, 2018.
Office Action for U.S. Appl. No. 15/666,486 dated Jul. 27, 2018.
Office Action for U.S. Appl. No. 14/508,922, dated Aug. 31, 2018.
Office Action for U.S. Appl. No. 15/441,184, dated Jul. 3, 2018.
Final Office Action for U.S. Appl. No. 14/929,240, dated Dec. 12, 2018.
Final Office Action for U.S. Appl. No. 15/666,486, dated Dec. 31, 2018.
Office Action for U.S. Appl. No. 14/929,240, dated Apr. 5, 2019.
Final Office Action for U.S. Appl. No. 14/508,922, dated May 2, 2019.
Office Action for U.S. Appl. No. 15/666,486, dated Jun. 5, 2019.
Office Action for U.S. Appl. No. 16/167,455, dated Jun. 14, 2019.

(56) References Cited

OTHER PUBLICATIONS

Notice of Allowance for U.S. Appl. No. 16/025,994, dated Jun. 26, 2019.
Notice of Allowance for U.S. Appl. No. 14/929,240, dated Sep. 4, 2019.
Office Action for Design U.S. Appl. No. 29/667,500, dated Sep. 11, 2019.
Final Office Action for U.S. Appl. No. 15/666,486, dated Nov. 27, 2019.
Final Office Action for U.S. Appl. No. 14/508,922, dated Dec. 6, 2019.

* cited by examiner

900

950

Wheel Results History Display

| | | | | | | | | |
|---|---|---|---|---|---|---|---|---|
| Wheel A | Black | 17 | 2 | | | | | 31 |
| | Green | | | | 00 | | | |
| | Red | | | 23 | | 9 | 3 | |
| Wheel B | Black | 2 | | 6 | 4 | 11 | | |
| | Green | | | | | | | |
| | Red | | 25 | | | | 23 | 1 |
| Wheel C | Black | | | | | 4 | | 22 |
| | Green | 0 | | | | | | |
| | Red | | 12 | 1 | 36 | | 19 | |

GAMING TABLE SYSTEMS FOR OVERLAPPING GAME PLAY

CROSS REFERENCE TO RELATED APPLICATION

This application is a continuation of U.S. patent application Ser. No. 14/929,240, filed Oct. 30, 2015, and entitled "GAMING TABLE SYSTEMS FOR OVERLAPPING GAME PLAY," the content of which is hereby incorporated by reference.

TECHNICAL FIELD

The present invention relates generally to electronic gaming systems, and more particularly to electronic gaming table systems having automated components.

BACKGROUND

Casinos and other resorts that offer wagering games, sports books, and other similar endeavors have grown substantially in popularity and sophistication in recent years. Wagering games such as baccarat, blackjack, roulette, craps, sic-bo, and poker, among many others, are popular table games offered in such establishments. These games are traditionally administered by human dealers on physical gaming tables having a dealer surface, felt or similar table top layouts, cards, dice, chips and the like. These games can also be played on electronic gaming machines where the dealer, playing cards, chips or other gaming elements may be virtual.

Many formats for these table games involve live games against the house or other players, other formats can involve electronic and online versions. In various electronic table system arrangements, players can be at the physical gaming table and/or located remotely from but still playing at the physical gaming table. As a particular example, "stadium style gaming" involves an arrangement where many players may participate at a given live action gaming table by way of remote gaming terminals. In some arrangements, dozens or even hundreds of players may participate at a single table in this manner. Many such arrangements involve the presence of a live dealer, and often there are no players at the actual live gaming table. The use of remote gaming terminals can also allow players to play at multiple live gaming tables simultaneously while being present only at one table or even while not being present at any single table.

The nature of table games can be different, however, such as where table games often take much longer to play than games on slot machines, video poker machines, and other gaming devices. For example, a typical game of roulette can take about two minutes to play, compared to a mere five seconds for a typical slot machine game. Faster players tend to get bored while waiting for game results and table administration activities, and casino operators can lose valuable time and revenue waiting for slower players to make decisions, for the game to finish, and for all wagers to be resolved.

While the administration of table games and other casino endeavors have worked well in practice over many years, there is always a desire for improvement. What can be improved then are electronic wager-based gaming table systems that permit faster game play that meets the speeds desired by particular players.

SUMMARY

It is an advantage of the present disclosure to provide improved table gaming table systems, particularly with respect to those that allow for greater flexibility and faster play of wager-based table games. This can be accomplished at least in part through the use of system servers that coordinate the timing of game play across multiple electronic gaming tables. In particular, a system server can control starting times for wager-based table games across the various system gaming tables, which can result in staggered table game starting times and the ability for players to play as many table games as they like simultaneously.

In various embodiments of the present disclosure, a gaming table system can include a plurality of electronic gaming tables that provide wager-based table games, a plurality of gaming terminals, and one or more system servers. Each of the plurality of electronic gaming tables can include a table controller adapted to control electronic gaming table functions and a table communication interface coupled to the table controller and adapted to facilitate communications between the table controller and one or more other gaming table system components. Each of the plurality of gaming terminals can include a terminal controller adapted to facilitate the simultaneous play by a single player of multiple wager-based table games at multiple of the plurality of electronic gaming tables, one or more display components coupled to the terminal controller and adapted to provide output to the single player regarding the simultaneous play of the multiple wager-based table games, and a terminal communication interface coupled to the terminal controller and adapted to facilitate communications between the terminal controller and one or more other gaming table system components. A first system server can be in communication with the plurality of electronic gaming tables and can control starting times of at least some of the wager-based table games played on the gaming tables.

In various detailed embodiments, at least one of the plurality of electronic gaming tables can include a physical surface for administration of the wager-based table games by a live human dealer. Also, at least one of the plurality of electronic gaming tables may provide no ability for any player to play at the electronic gaming table itself. Further, at least one of the plurality of gaming terminals can be located remotely from all of the plurality of electronic gaming tables. In various embodiments, the first system server controls the starting times by sending starting signals to the plurality of electronic gaming tables indicating when the wager-based table games are allowed to start. At least some of the starting signals can be sent in response to the occurrence of a triggering event.

In various detailed embodiments, the first system server can stagger the starting times of the wager-based table games. This staggering can result in a minimum time between the starting times of two consecutive wager-based table games across all of the plurality of electronic gaming tables, and such a minimum time can be between two and fifteen seconds. This staggering can also or alternatively result in a maximum time between the starting times of two consecutive wager-based table games across all of the plurality of electronic gaming tables. In various embodiments, a system server can also control which of the plurality of electronic gaming tables starts a next wager-based table game.

In various embodiments, one or more additional system servers can also be used, such as a second and third server, and such as for different functions. Each server can be in communication with gaming tables, gaming terminals, other servers, other system components, or any combination thereof. A system server can control gaming table usage such that each of the plurality of electronic gaming tables experiences about the same amount of usage. In some embodiments, a system server can also confirm that wagers received from the plurality of gaming terminals are placed within a proper time frame for their respective wager-based table games. A system server can facilitate the simultaneous play of multiple wager-based table games at multiple of the plurality of electronic gaming tables by one player at one gaming terminal. A system server can also be configured to verify eligibility of one of the gaming terminals to participate in the wager-based table games.

In various other embodiments of the present disclosure, an electronic gaming table system may include only a first system server in communication with a plurality of electronic gaming tables, wherein each of the plurality of electronic gaming tables provides wager-based table games that are playable from a plurality of gaming terminals that are each adapted for the simultaneous play of multiple wager-based table games at multiple of the plurality of electronic gaming tables. The first system server can controls starting times of new wager-based table games on at least some of the plurality of electronic gaming tables, such as by sending signals to the plurality of electronic gaming tables indicating when new wager-based games are allowed to start. Again, the first system server can stagger the starting times of the new wager-based table games. Further system components can include one or more additional servers. For example, a second system server in communication with and receiving inputs from the plurality of electronic gaming tables and the plurality of gaming terminals can facilitate the simultaneous play of multiple wager-based table games at multiple of the plurality of electronic gaming tables by one player at one gaming terminal.

In still further embodiments, various methods are disclosed for facilitating the simultaneous play of multiple wager-based table games at multiple physical electronic gaming tables. Such methods can be performed, for example, at a gaming terminal by a gaming terminal processor. Pertinent process steps can include providing simultaneously small displays for each of a plurality of electronic gaming tables hosting live wager-based table games, detecting a first user input indicating a first selected electronic gaming table from the plurality of electronic gaming tables, emphasizing the display for the first selected electronic gaming table, displaying a wager countdown clock for the first selected electronic gaming table, and accepting a first wager on a first game play at the first selected electronic gaming table. Further process steps can include detecting a second user input indicating a second selected electronic gaming table from the plurality of electronic gaming tables, accepting a second wager on a second game play at the second selected electronic gaming table, administering both of the first game play and second game play after accepting both of the first wager and the second wager, and resolving the first wager according to the outcome of the first game play.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed electronic gaming table systems for overlapping game play. These drawings in no way limit any changes in form and detail that may be made to the disclosure by one skilled in the art without departing from the spirit and scope of the disclosure.

DETAILED DESCRIPTION

Figure 1A:
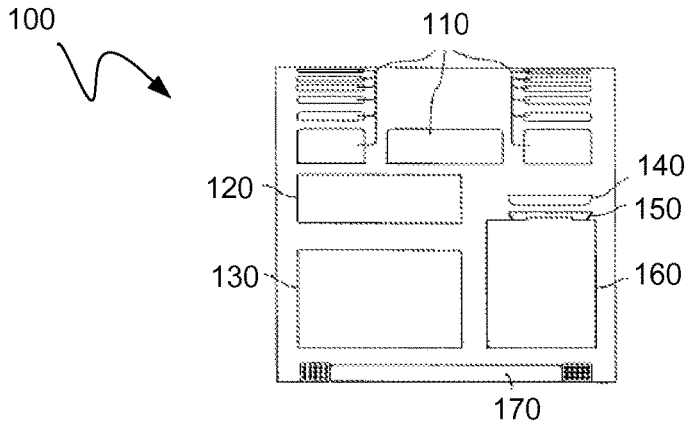
FIGS. 1A-1E illustrate in various views an exemplary gaming terminal adapted for the play of wager-based table games at physical electronic gaming tables according to various embodiments of the present disclosure.
Figure 1B:
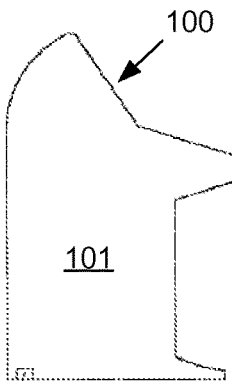
Figure 1C:
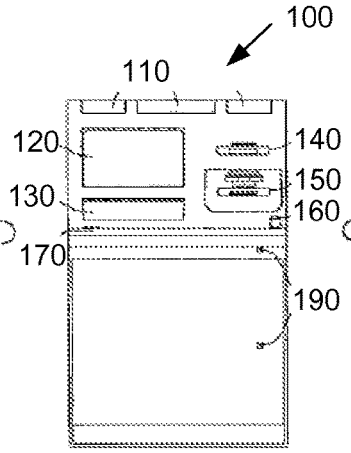
Figure 1D:
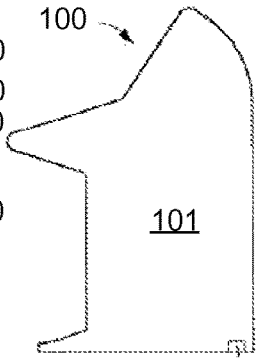
Figure 1E:
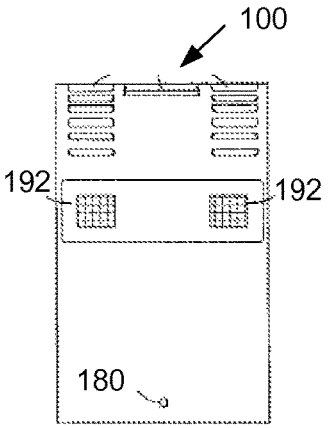

Exemplary applications of apparatuses and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting.

In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure generally applies to devices, systems and methods for providing, conducting, and facilitating the play of wager-based games at live physical electronic gaming tables that can include live dealers, live players, live gaming components, and electronic platforms. As such, this disclosure may be applied to any live table game, such as baccarat, blackjack, roulette, craps, pai gow, sic bo, poker, bingo, keno, card games, and the like, as well as any other type of game having a live or electronic dealer, and/or one or more players seated at and/or remotely from a physical electronic gaming table or comparable terminal. In some embodiments, there may be no players seated at a physical electronic gaming table itself, such that all players are playing at gaming terminals that are located apart from or even remotely from the actual physical surface of the gaming table. The various embodiments disclosed herein can be applied with respect to individual gaming terminals or other associated gaming devices, individual physical electronic gaming tables or other similar devices, individual system servers that facilitate the use of such devices, entire systems having any combination of multiples for each of these components, and methods of running table games on such devices and systems.

The various embodiments provided herein may be applied in a gaming table system that monitors live wager-based table games in which physical or virtual cards are dealt to one or more players at, near, or associated with multiple gaming tables. Alternatively, or in addition, other physical gaming elements can be employed, such as dice, wheels, reels, cards, chips, tokens and the like. The game play data collected can be used to enable play of the same live table games remotely through gaming terminals. The gaming terminals may be any platform capable of receiving and transmitting data, including "thin-client" platforms or platforms which do not process game play data and "smart" platforms or platforms which process game play data. The gaming terminal may be stationary, similar to the slot machines or electronic tables commonly seen at the physical casino, or portable electronic devices such as smart phones, computer tablets, portable media players, laptop computers, desktop computers, smart TV, smart glasses, and the like. Additionally, the respective gaming network can be of wired (Ethernet, Token Ring, Serial multidrop, etc.) or wireless variety (802.11x, BlueTooth, LTE, 2G/3G/4G cellular, Zigbee, Ultra Wide Band, etc.) known in the art. Thus, players interested in placing wagers on a live table games are not confined to the gaming table or casino floor.

In general, the present disclosure can pertain to one or more gaming terminals, one or more physical electronic gaming tables, and one or more electronic gaming system servers, among other system components. In various embodiments, a given gaming terminal, physical electronic gaming table and/or gaming table system allows remote player or gaming terminals to participate as if the remote player has a seat at the physical table. A relevant electronic gaming table system can include live electronic tables ("eTables"), remote game terminals (electronic gaming machine ("EGM"), smart phone, smart TV, tablet, desktop computer, etc.), a central games repository and a server that acquires the available live games from each eTable, indexes them and broadcasts the games and games history to other electronic tables, remote game terminals, and remote gaming sites, a multi-site games traffic server that receives remote game requests, verifies a player's eligibility (location, ID, funds, player profile, play history), enforces jurisdictional rules, and routes eligible bets to the player's requested game "channel" being broadcast, a financial server that acts as a Central Clearinghouse for remote wagers, and a network that connects the electronic tables, remote game terminals, the games repository and router, and the financial clearinghouse server.

A table processor and/or remote server can be used to administer the game, track player decisions and decide game outcomes for each player accordingly. Other components and items may also be present as desired. In addition to the various components, details and other aspects set forth herein with respect to the disclosed player terminals, gaming table systems and remote gaming in general, further details and explanations regarding such player terminals, electronic gaming tables and remote table game systems can be found at, for example, U.S. Pat. Nos. 7,914,368; 7,918,723; 7,922,587; 8,182,321; 8,210,920; 8,308,559; and 8,323,105, as well as U.S. patent application Ser. Nos. 13/948,101; 13/893,340; 13/844,617; 13/542,446; 13/456,110; 13/042,633; and 11/198,218, with these references being incorporated herein by reference in their entireties and for all purposes.

Various disclosed embodiments facilitate faster game play at multiple electronic gaming tables across entire systems, so as to meet the speeds and flexibility desired by faster and other particular game players. This is accomplished at least in part through the use of gaming table systems that facilitate the overlapping or simultaneous play by a single player of multiple wager-based table games at multiple different electronic gaming tables. This is also enhanced by system servers that coordinate the timing of game play across multiple electronic gaming tables. In particular, a system server can control starting times for wager-based table games across the various system gaming tables, which can result in staggered table game starting times and provide players the ability to play as many table games as they like simultaneously. In various embodiments then, a player can view multiple games at varying stages along the full table gaming cycle of game states, including game open, wagering, confirmation, start, play, resolution, payouts, and close. The player can then pick and choose which game or games are desired for play, and can jump back and forth between many games with the aid of knowing when betting will open and close in a staggered manner for every table that is viewable.

Turning first to FIGS. 1A-1E, an exemplary gaming terminal adapted for the play of wager-based table games at physical electronic gaming tables is shown according to various embodiments of the present disclosure. FIG. 1A is a top plan view, while FIGS. 1B through 1E are side, front, side and back elevation views respectively. As noted herein, gaming terminal 100 can be referred to in a number of different ways, such as, for example, a gaming terminal, an electronic gaming machine ("EGM"), a player terminal, an electronic player terminal, and the like. Gaming terminal 100 can be linked to various different types of table games, and can be linked to multiple different tables, servers, and/or other system components, including simultaneously. A gaming terminal or player terminal can include any suitable EGM, and may include any platform capable of receiving and transmitting data, including "thin-client" platforms or platforms which do not process game play data and "smart" platforms or platforms which process game play data. A player terminal may be stationary, similar to the slot machines or electronic tables commonly seen at the physical casino, and/or may include various types of portable electronic devices such as smart phones, computer tablets, portable media players, laptop computers, desktop computers, smart TV, smart glasses, and the like.

Although a wide variety of possible layouts and arrangements can be applied to any given EGM or gaming terminal 100, a particular configuration is provided herein simply for purposes of illustration. As is generally shown in FIGS. 1A-1E, gaming terminal 100 can include an outer housing 101 that may include a processor or controller (not shown) located therein. Numerous input and output components can be located at various locations about gaming terminal 100. One or more lights or lamps 110 can indicate various status by way of lit, unlit and color arrangements. An upper screen 120 and lower screen 130 can provide various displays to a player, as well as touchscreens that accept player input. Alternatively, or in addition, one or more buttons may also be provided for player inputs. Other components can include a ticket printer 140, bill acceptor 150, shelf 160, and one or more speakers 170. Gaming terminal 100 may also include power input 180, a locking mechanism 190 and one or more fans 192 or other cooling components. Of course, many other input and output components may also be provided at gaming terminal 100, as will be readily appreciated. Further, other configurations, arrangements, shapes and sizes for the player terminal may also be used.

Figure 1F:
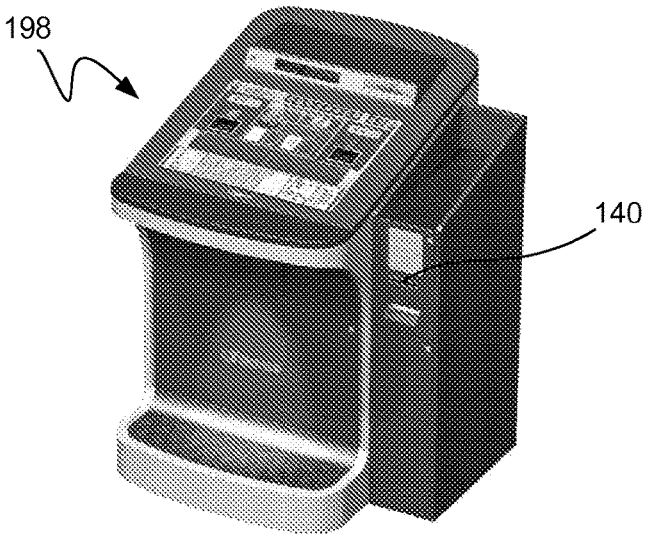
FIG. 1F illustrates in front perspective view an exemplary alternative gaming terminal adapted for the play of wager-based table games at physical electronic gaming tables according to various embodiments of the present disclosure.

FIG. 1F illustrates in front perspective view an exemplary alternative gaming terminal adapted for the play of wager-based table games at physical electronic gaming tables according to various embodiments of the present disclosure. Alternative gaming terminal 198 can be functionally identical or similar to gaming terminal 100, while differing in overall appearance, such as in size, shape, color, display location, button and input locations, and the like. Various identical or similar items may also be located on alternative gaming terminal 198, such as, for example, a ticket printer 140.

Figure 1G:
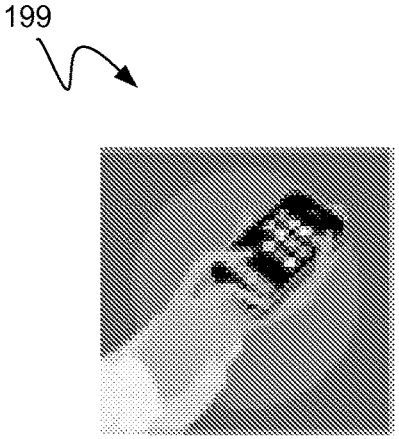
FIG. 1G illustrates in front perspective view still another exemplary alternative gaming terminal adapted for the play of wager-based table games at physical electronic gaming tables according to various embodiments of the present disclosure.

FIG. 1G illustrates in front perspective view still another exemplary alternative gaming terminal adapted for the play of wager-based table games at physical electronic gaming tables according to various embodiments of the present disclosure. Alternative gaming terminal 199 can be a smart phone or other portable user device that is configured to facilitate the play of live table games thereupon. Alternative gaming terminal 199 can also be functionally identical or similar to gaming terminal 100, although some abilities and features obviously may not be present, such as a ticket printer. In various embodiments, alternative gaming terminal 199 can be owned or controlled by an individual player, rather than a casino or other gaming establishment.

Figure 2A:
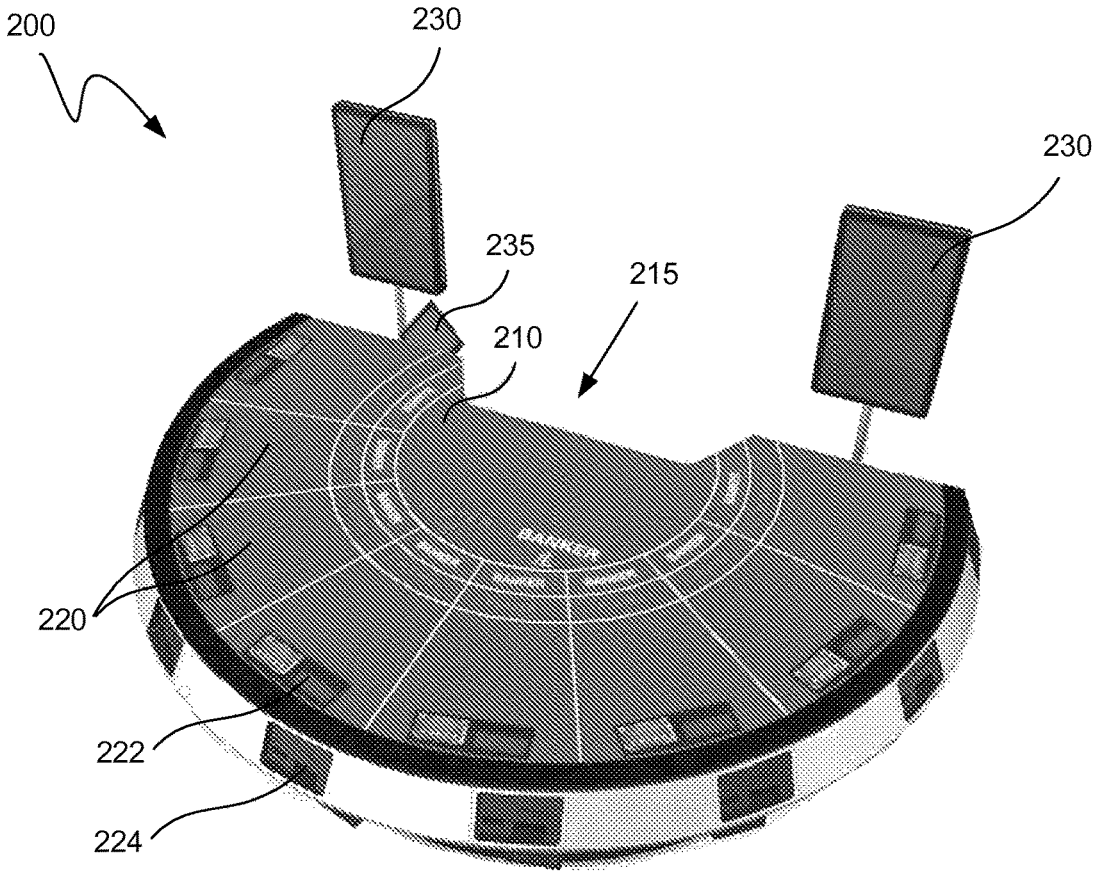
FIGS. 2A and 2B illustrate in top and front perspective views an exemplary physical electronic gaming table adapted for the play of wager-based table games according to various embodiments of the present disclosure.
Figure 2B:
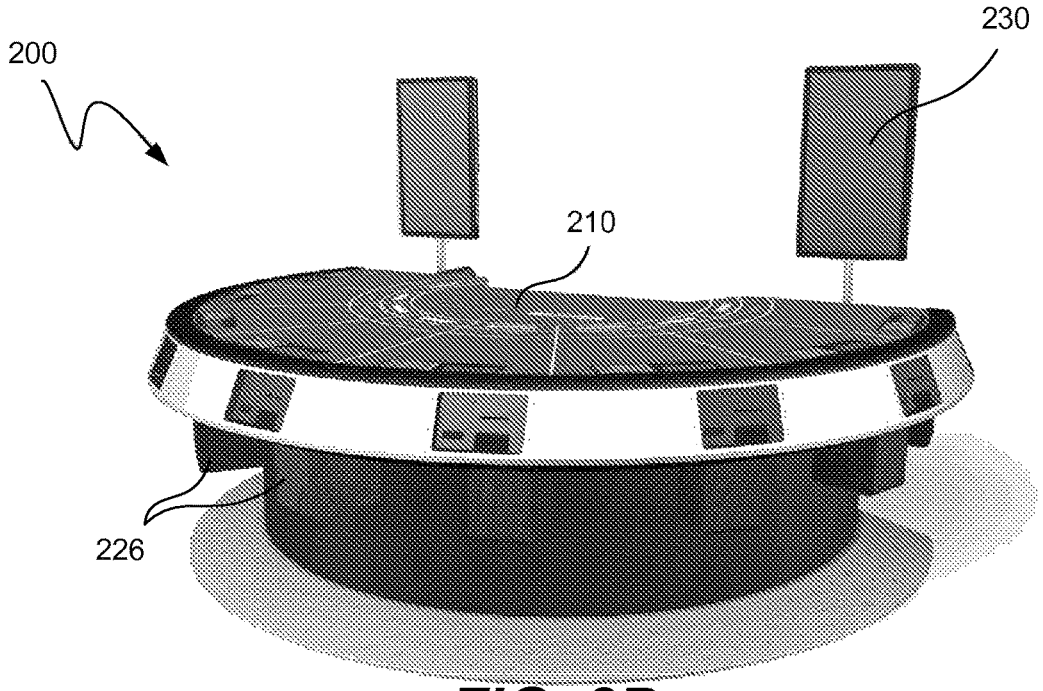

Referring next to FIGS. 2A and 2B, an exemplary physical electronic gaming table adapted for the play of wager-based table games according to various embodiments of the present disclosure is illustrated in top and front perspective views respectively. It will be readily appreciated that this physical electronic gaming table ("eTable") 200 can also be provided in numerous other configurations and formats, such that the provided example is for illustrative purposes only. The eTable 200 can include a playing surface 210 adapted for the play of live table games using live physical components, a live dealer station or region 215, a plurality of optional player stations 220, each of which may have its own displays 222, bill acceptor, card acceptor and other input components 224, and one or more community displays 230. One or more physical separators 226 may separate the different player stations 220. In some embodiments, eTable 200 might have no player stations, such that a live dealer merely plays or administers a live game at a table with no players, whereby all player action occurs at remote gaming terminals, such as one or more of electronic player terminal 100 above and/or one or more portable devices, as set forth in greater detail below.

Live dealer station or region 215 may include a dealer display and/or dealer inputs, such as by way of a dealer computing device 235, one or more ticket printers (not shown), one or more dedicated cameras (not shown), and/or various other items that aid a live dealer at the electronic gaming table 200. Dealer station or region 215 may also be referred to as a "dealer terminal" for purposes of an overall system, and can provide for a variety of specific live dealer related functions. For example, dealer terminal 215, such as by way of a dealer display, tablet, and/or other computing device 235, can provide for a dealer log in/out, information broadcasts, and/or manual overrides in case of errors, such as where an eShoe delivers too many cards or an automated hand resolution or payout is wrong. Each optional player position 220 around the eTable 200 can have a player terminal integrated into it. Like a standalone remote gaming terminal 100, each player terminal can have its own controller, buttons, touchscreen display, bill validator, printer, card reader, and so forth. The player terminals can be connected to a table controller ("TC") for the entire table via a switch/hub, and the TC connects to an overall local or wide area network, as provided in greater detail below.

Each eTable 200 can be hosted by a live human dealer, such as at a dealer station 215. The live human dealer can deal real cards and/or use real dice or other physical game components, which can be done on a wooden green-felt table surface 210, for example. Of course, other materials and/or colors may also be used. The cards can be drawn from an electronic shoe ("eShoe"), which is connected to the TC on the local table network. In some embodiments, the eShoe scans the cards and reads the rank and suits for each card removed. The TC, via player login data (such as player tracking card swipe or a cash insertion at the bill acceptor), knows which positions at the table are active and thus can monitor the progress of a game. One or more table sensors, such as a camera, RFID reader, or the like, can be used to capture video of the dealer action for broadcasting, as well as tracking of players and physical game components through a variety of means. The camera can also be used to further verify and keep a log of game activities, such as, for example, cards removed from the eShoe, cards dealt to player positions, bets entered, new players, and the like.

The eTable 200 can also have one or more displays. In one embodiment, there can be one or more community displays 230 to show common player information, such as community cards, table wager minimum, casino name, time, advertisement, and the like. Game history (e.g., baccarat roadmaps) may also be displayed on the same screen 230 or on a separate screen attached to or near the eTable 200. The eTable may also have discrete displays such as On/Off/Flashing lights mounted underneath table graphics to annunciate game information such as Banker Win, Player Win, New Game, No More Bets, and so forth. Such table screens and discrete displays can be driven by the TC.

Figure 3:
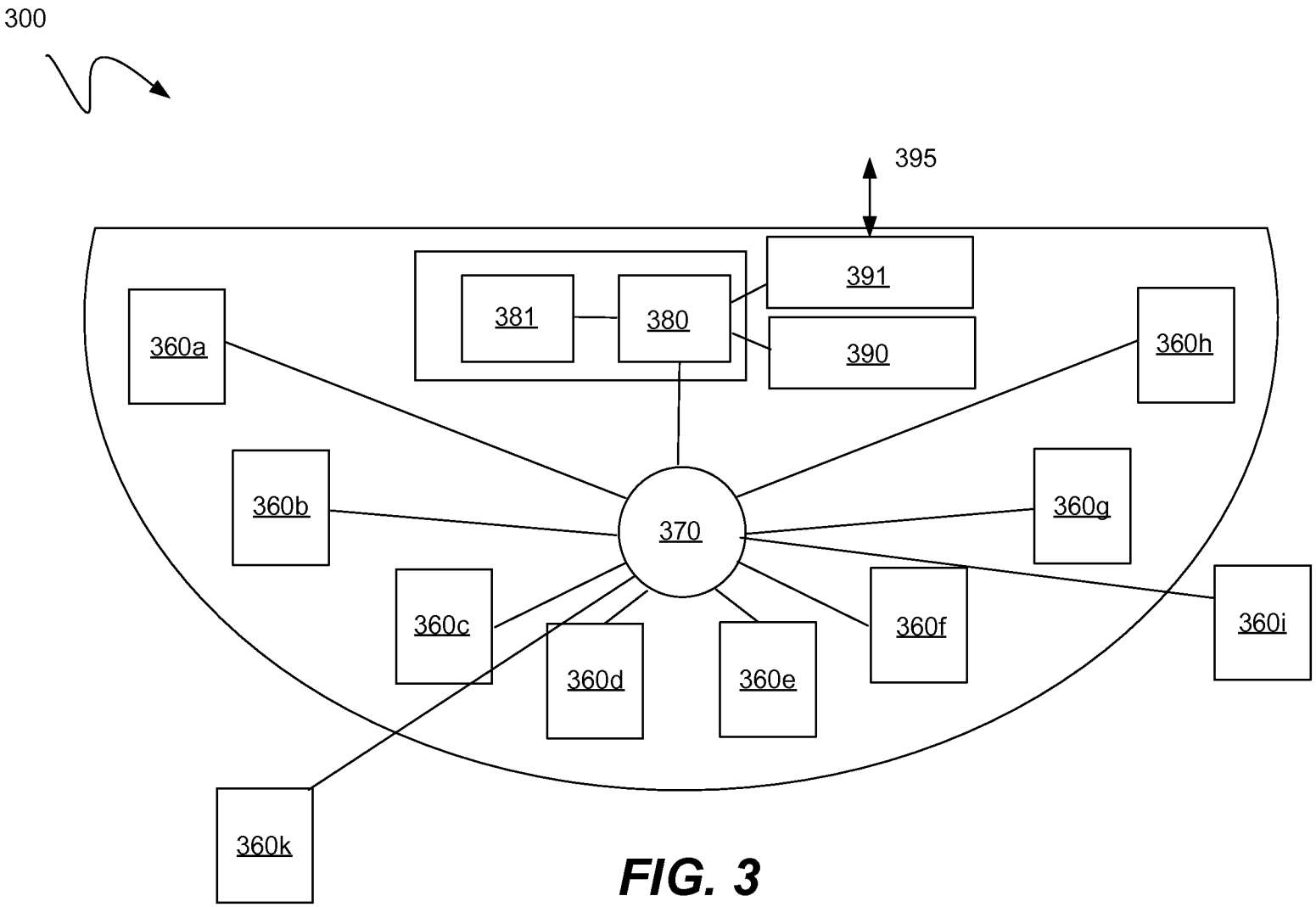
FIG. 3 illustrates in block diagram format an exemplary computing system for a physical electronic gaming table adapted for the play of wager-based table games according to various embodiments of the present disclosure.

Continuing with FIG. 3, an exemplary computing system for a physical electronic gaming table adapted for the play of wager-based table games is provided in block diagram format. In various embodiments, computing system 300 can be implemented on the physical electronic gaming table 200 set forth above. Computing system 300 for an eTable can include various individual processors and peripherals 360*a*-360*k* for a plurality of player terminals or stations. In various embodiments, each of these separate items can be an identical or substantially similar set of processors, displays, inputs and other components, as may be desirable for each separate player station. As shown, some of the player stations (e.g., 360*a* through 360*h*) may be physically present at the eTable, while other player stations or terminals (e.g., 360*i* and 360*k*) may be located away from the eTable. Such remotely located player stations or terminals can be nearby the table and within view of the playing surface and or an overhead display of the playing surface. In addition, one or more remotely located player stations or terminals can be located in a different room or different location entirely, such as where a video feed of the live table game can be provided to the player station for live play. Such remotely located player terminals can take the form of any of gaming terminals 100, 198, 199 above, and/or can be implemented on a third party user device, such as a smart phone, tablet, laptop, PDA, smart glasses, or the like, such as alternative gaming terminal 199.

All of the player station systems 360*a*-360*k* can couple to a central router or hub 370, which can be coupled to a master table controller ("TC") having a CPU 380 and memory or storage 381. As in the foregoing embodiment, a dealer station (not shown) may also be coupled to the TC, such that a live dealer may be able to provide input to the table as well. The TC can be coupled to one or more table displays 390, as well as an interface 391 for outside communications. Such table display(s) 390 can provide views of the playing surface to players that may be nearby the table but not in position to have a good view of the playing surface. In this manner, dozens or hundreds of players can be playing at a single table. Link 395 represents a connection to the network, so that system 300 is able to communicate with various other outside network or system components, such as a remote game server.

In various embodiments, a remote game server can administer some or all of the game away from the actual physical electronic gaming table. The remote server can have the rules of the game, and can be responsible to conduct the table game, such that the TC only conducts data acquisition. As such, the TC can be connected to the card shoe, shuffler, camera(s), dealer terminal, chip counter, overhead display(s), and so forth. In operation, the TC can collect raw data from these peripherals and then provide this data to the host game server located remotely. The remote host or game server can then provide any number of functions, such as, for example, to process the game according to game rules, store the game states, keep track of game history, resolve player hands, credit or debit player accounts, run the community display, and the like. Data from each player terminal can be collected by the table controller or processor (i.e., TC) and forwarded to the remote server, can be sent to the remote server directly from player terminals, or some combination thereof.

In various embodiments, there may or may not be live players at the eTable. That is, in some embodiments the eTable may not have any live players sitting at the table, and rather has only the dealer, playing surface, cards and/or other live physical game components. In such embodiments, all live players may wager on and participate in the game action through remotely located gaming terminals. Again, such remotely located gaming terminals may be nearby the eTable and within view of the playing surface and/or one or more community displays. For example, such nearby player terminals can be within 100 feet of the eTable. Of course, further distances and/or removed locations to other rooms or properties are also possible, such as where the remotely located players can view a video of the live game action.

Figure 4:
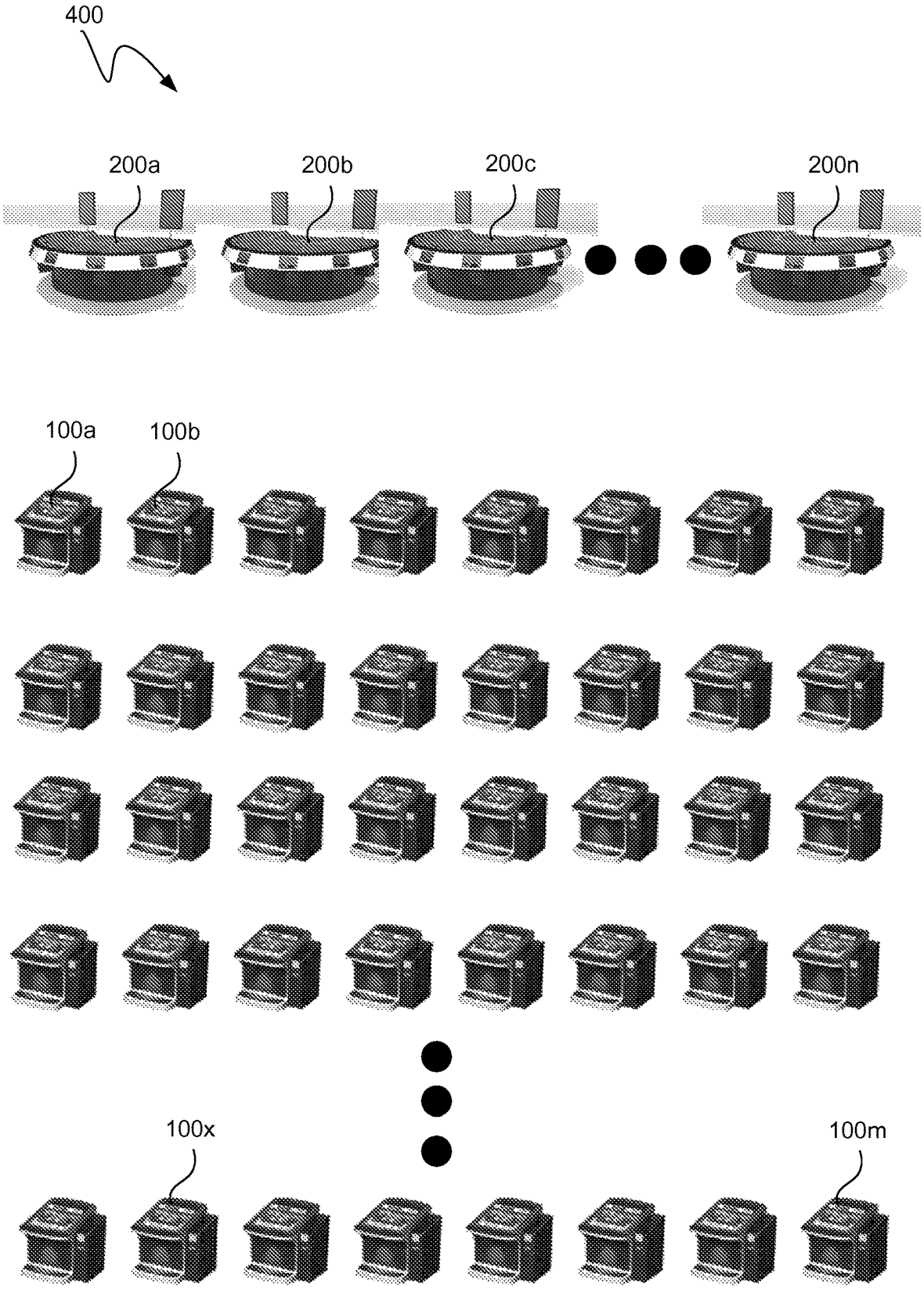
FIG. 4 illustrates in block diagram format an exemplary gaming table system having multiple gaming terminals and multiple physical electronic gaming tables according to various embodiments of the present disclosure.

Moving now to FIG. 4, a block diagram is provided for an exemplary gaming table system having multiple gaming terminals and multiple physical electronic gaming tables according to various embodiments of the present disclosure. Localized gaming table system 400 can include a plurality of eTables 200*a*-200*n*, as well as numerous gaming terminals 100*a*-100*m* arranged in the vicinity of and in view of the eTables. As one example, each of about 40 gaming terminals 100*a*-100*m* can be in communication with each of about 4 eTables 200*a*-200*n*. While about 4 physical electronic gaming tables and about 40 gaming terminals are shown, it will be understood that more or fewer gaming tables and more or fewer gaming terminals may be provided in a given gaming table system set forth on one or more given casino floors and/or other locations. For example, a gaming table system might have 10 or more physical electronic gaming tables in some arrangements.

In various embodiments, a player at a given gaming terminal 100*x* may be provided the ability, such as by way of a button or other input, to switch between any combination of different physical electronic gaming tables 200*a*-200*n*. Further, the player at the given gaming terminal 100*x* may also be allowed to play multiple wager-based table games simultaneously at multiple different physical electronic gaming tables 200*a*-200*n*. For example, the player may be permitted to play table games at one, some, many, or all of the gaming tables 200*a*-200*n*, depending upon the choices of the player. Where the player is a fast player that likes to play lots of different table games at once, the player might choose to play games at all of the different physical electronic gaming tables 200*a*-200*n* simultaneously. Alternatively, the player may decide to play games at only one or two of the various system gaming tables. One, some, or all of the gaming terminal 100*a*-100*m* may be configured to allow for a given player thereat to choose the exact number of games desired to play simultaneously.

Figure 5:
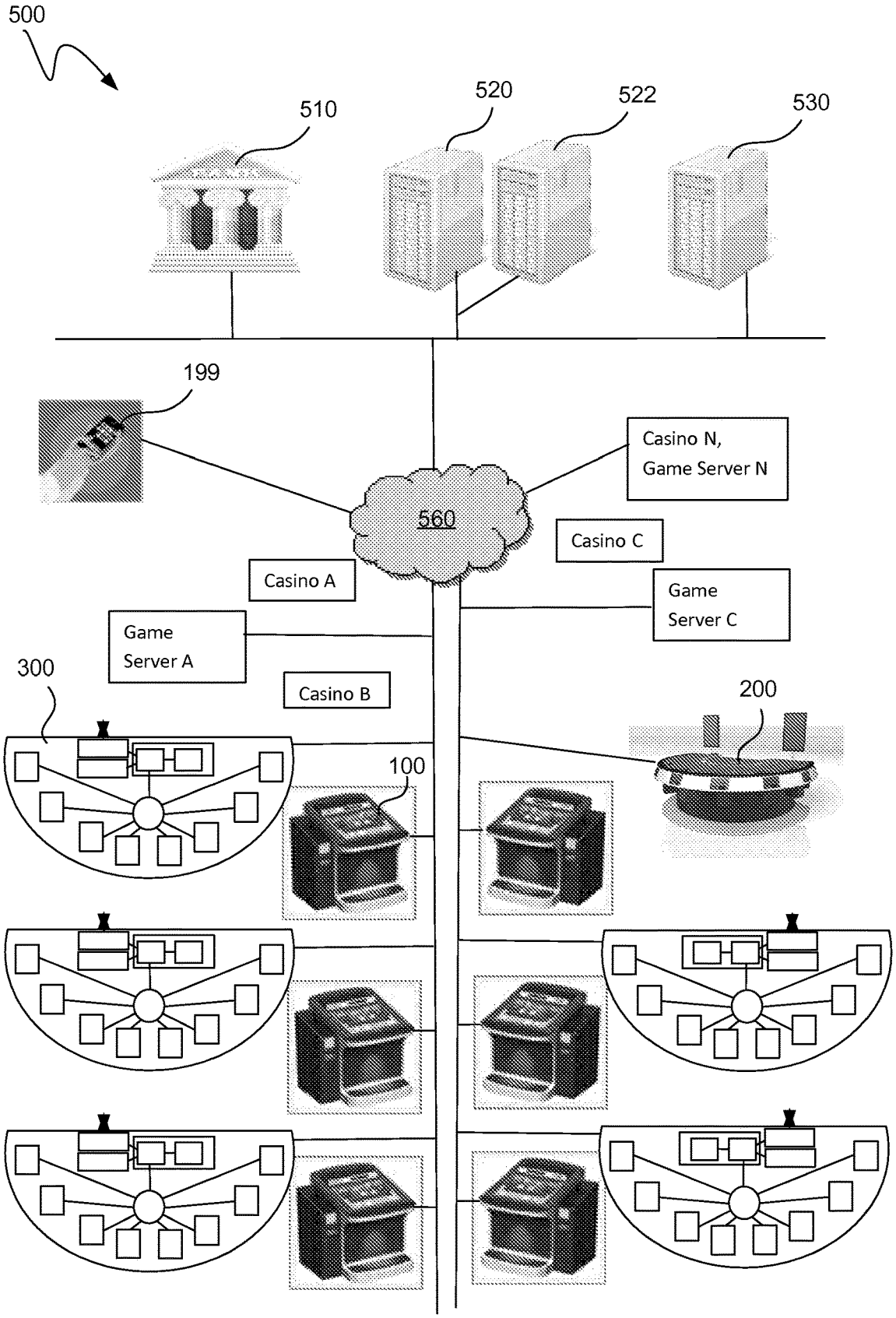
FIG. 5 illustrates in block diagram format an exemplary gaming table system having multiple gaming terminals, multiple physical electronic gaming tables, and multiple system servers across multiple locations according to various embodiments of the present disclosure.

FIG. 5 illustrates in block diagram format an exemplary gaming table system having multiple gaming terminals, multiple physical electronic gaming tables, and multiple system servers across multiple locations according to various embodiments of the present disclosure. Gaming table system 500 can be a wide area system that includes a variety of components and items, such as a bank 510, one or more system servers 520, 522, and a financial clearinghouse 530, among other possible components and items. A cloud 560 or network can couple these items to various eTables, gaming terminals, game servers, casinos, and other distributed components. One or more personal devices 199 can serve as remote player terminals in some embodiments, as noted above. Various networked casinos, game servers, eTables 200, 300, and other remote terminals 100 can also be coupled through the cloud 560 or network in gaming table system 500. As will be readily appreciated, some or all of the remote terminals in gaming table system 500 can take the form of player terminal 100 set forth above, as well as any suitable variation thereof.

One or more system servers 520, 522 and game servers may be present in gaming table system 500, and each can operate in a particular manner to facilitate the play of the various table games set forth above. In such embodiments, a given game server can collect live game information from each eTable, apply game rules, and return game results. Beside monitoring and controlling the games, a game server can also keep track, in a database, of game history of each eTable, accounting information, revenue reports, maintenance information, and the like. Each of these individual functions can be performed by a separate application on a separate server, or integrated into one application running on one comprehensive server. The determination of one or multiple servers and applications depends on the number of eTables, game stations, and/or remote gaming terminals, both local and remote, that are being connected across the system.

Each separate casino or gaming establishment can have a singular or multiple game servers, and each game server can be configured to serve a particular game type (e.g., baccarat, blackjack, roulette, craps, and the like), a quantity of tables, gaming terminals or game stations, or an area of the casino. In a multi-game, multi-site environment, one important function of the game server is the handling of financial transactions from remote game terminals. In some situations, remote game terminals can be logged into a particular eTable. From there, the remote player either participates directly as if he or she is sitting at the table, or back bets on one of the players at the table. In gaming table system 500, however, a remote player need not be constrained to any particular physical eTable. For instance, a player sitting at a seat on a local eTable can wager on the game on going at the local table and at another table at the same casino, or at an eTable at a casino located elsewhere. These capabilities are enabled by a network of game servers, one or more system servers 520, 522, and a central financial clearinghouse 530 for remote wagers. Further details regarding a wide area electronic gaming table system utilizing multiple system components across multiple locations can be found at for example, U.S. Pat. Nos. 7,914,368; 7,918,723; 7,922,587; 8,182,321; 8,210,920; 8,308,559; and 8,323,105, as well as U.S. patent application Ser. Nos. 13/948,101; 13/893,340; 13/844,617; 13/542,446; 13/456,110; 13/042,633; and 11/198,218, with these references again being incorporated herein by reference in their entireties and for all purposes.

Gaming table system 500 may also be configured to allow a player at a single gaming terminal to play multiple wager-based table games simultaneously at multiple different physical electronic gaming tables within the system. To allow the player to play at his or her preferred number of table games at different gaming tables simultaneously, the play of games across some or all of the system gaming tables can be coordinated and controlled. For example, the starting times of various table games can be specifically staggered across some or all of the system gaming tables. In this manner, the starting times of many table games can be spaced apart, which can be done in an even or measured fashion, such that multiple games do not start at or about the exact same time. This can be accomplished through the use of one or more system servers 520, 522 and other system components, as set forth in greater detail below.

Figure 6:
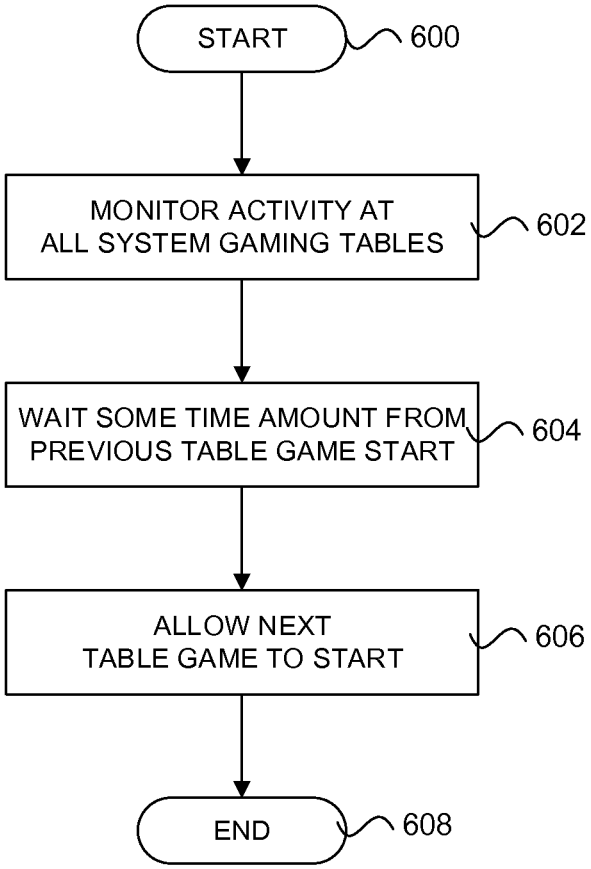
FIG. 6 illustrates a flowchart of an exemplary method for controlling starting times of wager-based table games according to various embodiments of the present disclosure.

Turning next to FIG. 6, a flowchart is provided of an exemplary method for controlling starting times of wager-based table games at a high level. After a start step 600, gaming activity can be monitored at all gaming tables within a gaming table system at process step 602. At a subsequent process step 604, a wait can be implemented for some amount of time from the start of a previous table game. This wait can be a set minimum amount of time, a set maximum amount of time, some other designated amount of time, or pendent upon a triggering event, for example. The previous table game can be the last table game to start across the entire gaming table system, for example, such that the previous table game and the next table game are consecutive table games across all gaming tables in the overall system. In some embodiments, the wait time may be set to zero, such as where the previous table game already started quite some time ago. At process step 606, the next table game across the entire gaming table system can be allowed to start. The method then ends at an end step 608.

As will be readily appreciated, this method can allow for controlling the starting times across all of the wager-based table games that are provided and administered throughout the entire gaming table system such that the starting times of the various games are staggered. By staggering the starting times of the various games, different games do not start right at the same exact time, and players can be allowed to play as many games simultaneously as they want due to the deliberate staggering or spreading out of game start times.

Figure 7:
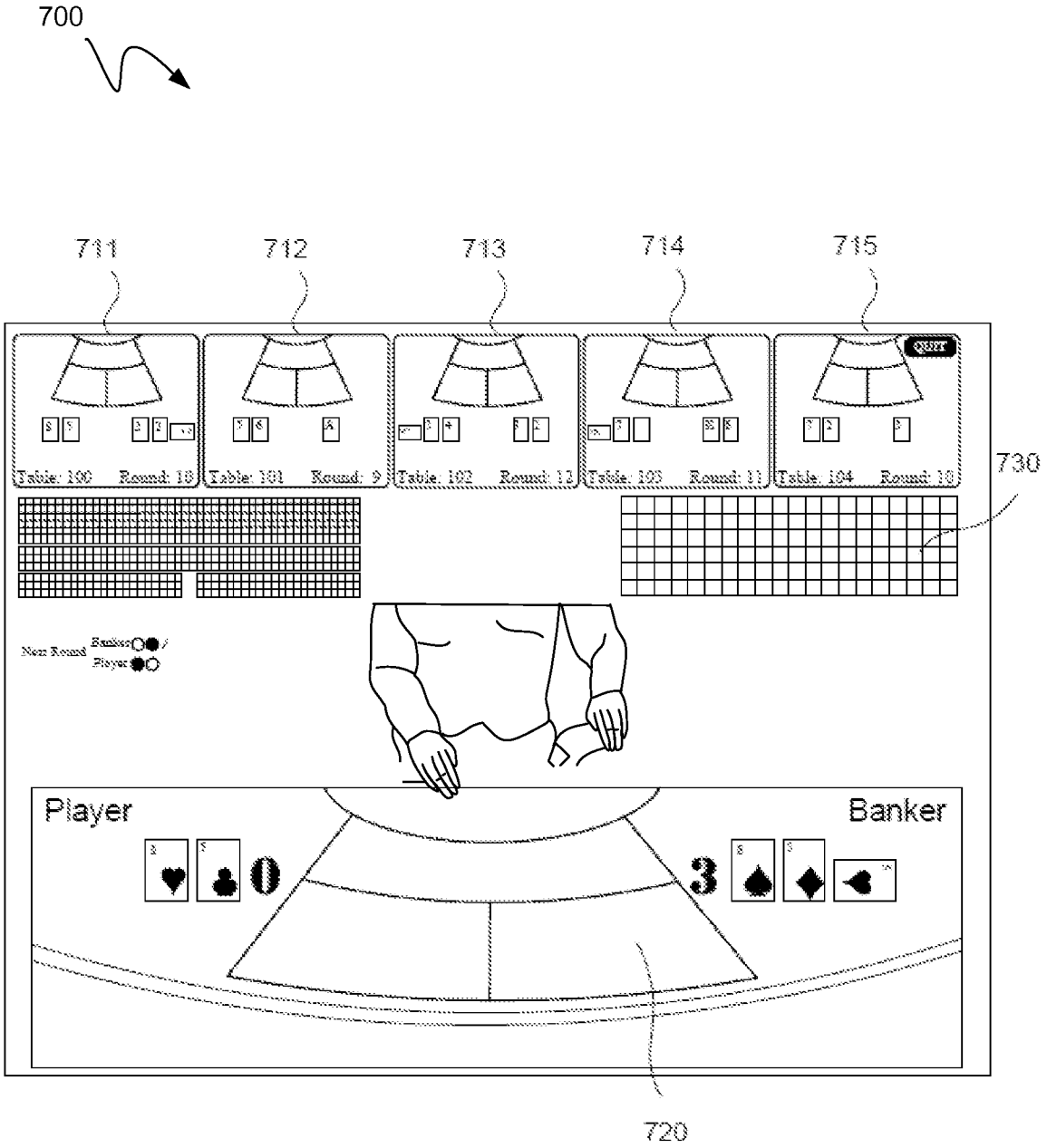
FIG. 7 illustrates an exemplary screenshot from a graphical user interface at a gaming terminal adapted for the simultaneous play of multiple wager-based table games at multiple physical electronic gaming tables by a single player thereat according to various embodiments of the present disclosure.

Moving now to FIG. 7, an exemplary screenshot is provided from a graphical user interface at a gaming terminal adapted for the simultaneous play by a single player of multiple wager-based table games at multiple physical electronic gaming tables. Screenshot 700 can represent what might be ordinarily presented to a user or player at a given gaming terminal 100, 198, or 199, for example. Multiple small displays 711-715 can be presented, each of which can represent a different gaming table. These small displays 711-715 can represent all of the system gaming tables, only the active gaming tables, or only a subset of the active gaming tables. While only five small displays 711-715 are shown here, more or fewer small displays might be also presented in a given screenshot or presentation. For example, ten or even twenty small displays might be presented at one time. Preferences for how many and/or which gaming tables are presented in this manner might be set by the operator, the player, or both.

In addition to the number of small displays 711-715 representing various system gaming tables, a primary display 720 can be an enlarged representation of a featured or selected gaming table. Primary display 720 can provide a larger view and added features that may not be feasible for the smaller views of small displays 711-715. For example, primary display 720 might include a live video feed of the actual table and/or dealer, and may also include a live audio feed as well. Larger representations of cards, wheels, tokens, chips, and the like may also be present, as well as added graphical features or items. The dealer may be a live human dealer, or may be a virtual computerized dealer. In addition primary display 720 may provide the main vehicle to allow a player to make wagers on an upcoming game, such as the next game play at the gaming table featured in primary display 720. Further graphical representations, such as game histories in the form of a roadmap 730 may also be presented.

In various embodiments, each of the small displays 711-715, and also primary display 720, can provide enough visual indicia or information to allow the player at the respective gaming terminal to tell what is happening at each of the displayed gaming tables. That is, the player can tell what game state or phase of a game is taking place at each table. The various game states can include, from start to finish, game open, wagering, confirmation, start, play, resolution, payouts, and close, after which the game states all repeat. In particular, by showing what is happening at each of the displayed gaming tables, the player can know which games are currently allowing wagers to be made and which games are soon to be in a game state where wagers are allowed. This can be particularly useful where the game starts are all deliberately controlled to be staggered, such that the player can switch to one of the currently available or soon to be available games just as soon as the player desires to play again.

For example, the six gaming tables depicted in small displays 711-715 and primary display 720 can all have staggered and spaced apart start times to their respective games, such that a new table game on these six tables starts every 15-20 seconds at a typical live gaming table pace. Of course, a new table game can start even faster, such as every 2, 5, or 10 seconds, if more gaming tables are part of the overall gaming table system. As such, a player can elect to play in as many or as few games simultaneously as he or she is comfortable, since new games start every few seconds. In various embodiments, a player may have the option to create multiple enlarged or primary displays, rather than just one. Also, a player may have the option to open additional small windows in order to view or monitor progress at more system tables.

Figure 8:
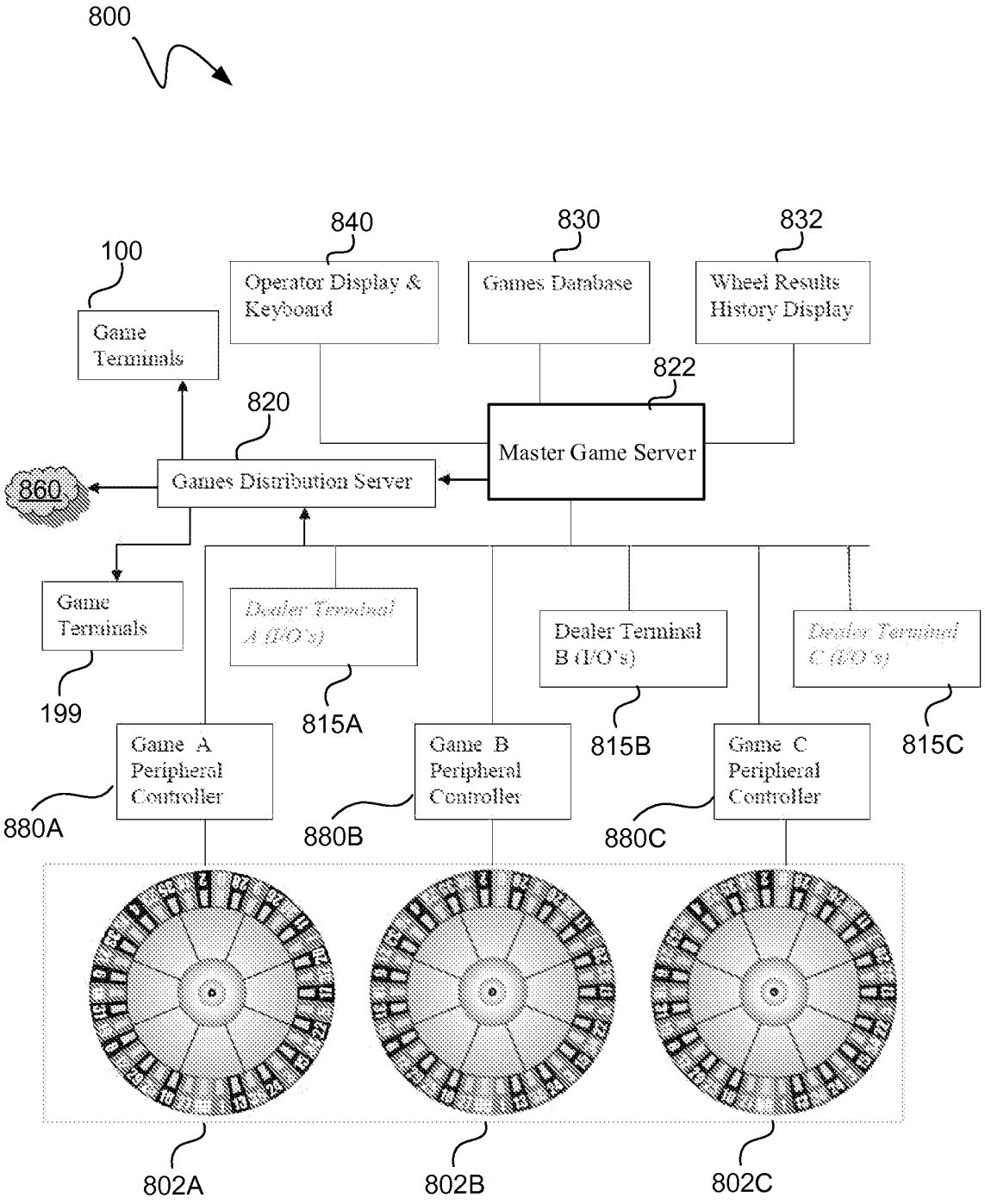
FIG. 8 illustrates in block diagram format an exemplary gaming table system having electronic gaming tables, a games distribution server, and a master game server according to various embodiments of the present disclosure.

FIG. 8 illustrates in block diagram format an exemplary gaming table system having electronic gaming tables, a games distribution server, and a master game server according to various embodiments of the present disclosure. Similar to foregoing embodiments, gaming table system 800 can include multiple game terminals 100, 199, or the like, multiple gaming tables 802A, 802B, 802C, multiple system servers 820, 822, and various other system components, some or all of which can be in communication directly and/or through cloud 860 or other suitable network. Each gaming table 802A, 802B, 802C can have its own separate table or peripheral controller 880A, 880B, 880C respectively, as well as its own dealer terminal 815A, 815B, 815C respectively. Some or all of the system gaming tables can be in communication with a games distribution server 820 and also a master game server 822. Other system components can include a games database 830, wheel or other game results and history displays 832, and an operator display and keyboard 840, among other possible items.

While only three roulette gaming tables are shown, it will be readily appreciated that many more roulette tables may be present, and that many other types of gaming tables, and multiples of each, may also be present in gaming table system 800. For example, there might be 10 different roulette tables in a given system. In such an arrangement, there might be 10 different live human dealers, with one at each table. Alternatively, there might be 5 live human dealers, with each dealer running two different gaming tables. This can be facilitated in many automated arrangements where the overall system is configured to detect the results and make the payouts to players, such that the live dealers only need to spin the wheel and drop the ball. Similar ease of dealing can also take place for baccarat, craps, blackjack, and other table games where dealers do not need to determine game outcomes and make player awards manually.

As noted above, each table controller 880A, 880B, 880C can control all local matters at its own respective gaming table, and can communicate game information and other data to one or more servers, such as games distribution server 820 and/or master game server 822. Among the functions to be controlled by a given table controller 880, these can include monitoring game states and allowing only certain actions at each game state on its respective gaming table. The various game states can first include a game open or new game state. This can involve the announcement or indication of a new game, and may include an invitation to wager and a setting of a wagering timer or clock. The next game state can include a wagering state, which can involve a window during which wagers are accepted and can also include the use and display of a wagering or countdown clock, the expiration of which closes the wagering window. A next game state can be a confirmation state, where confirmation of player wagers is provided to players, and wager information is also sent to the game server and/or other appropriate system components. A game initiation or game start state comes next, which is the point at which game play begins. Actual game play comes next, after which comes a game resolution or evaluation state, where the game outcome is determined and entered into the system. A game payout or resolving state comes next, where wagers are collected and awards are made. Finally, a close or end of game state can involve the closing of the game and readying for the next game open.

Each dealer station or terminal 815A, 815B, 815C can be dedicated to taking care of games at its own respective gaming table 802A, 802B, 802C. This can include signaling for the beginning of games, signaling the end of games, and signaling game outcomes. Each dealer station or terminal can also keep a record of all games played and outcomes at its respective table, which data can be used for dispute resolution, and also for creating useful game histories and roadmaps. Such game histories and roadmaps can be provided on large community or group displays, for example. Each dealer station or terminal can also be provided with the ability to override or correct errors in the automated components of game play and results, and may also have the ability to determine and enter game results in addition to what is determined by the system automatically, such as for redundancy purposes.

In various embodiments, the games distribution server 820 can function as a router that facilitates routing and communication of data between some or all gaming tables, gaming terminals, and servers. Games distribution server 820 can provide live feeds and game data from each gaming table 802A, 802B, 802C to the master game server 822 and each of the game terminals 100, 199. Games distribution server 820 can also provide wagering requests and information from each of the game terminals 100, 199 to the master game server 822 and or the individual gaming tables, as may be appropriate. Routing of game information and feeds by the games distribution server can take place locally and/or remotely, such as through the cloud or other network, even across state or country lines.

The master game server 822 can provide several different functions all from one server. Alternatively, as noted above, these functions can be separated and performed by separate servers, as may be desired. As one function, master game server 822 can receive all wagers from players at the gaming terminals, and can then determine which gaming tables the wagers apply to, as well as whether the wagers are appropriate and accepted. For example, a wager for a given gaming table can be appropriate if made during a proper time window, but would not be appropriate if made before or after that wagering time window. A received wager may also be appropriate or not appropriate based upon size (wager limits) and/or eligibility of the gaming terminal from which it was made. For example, master game server 822 may also have a compliance component that determines whether a remote gaming terminal is in a proper gaming jurisdiction or is otherwise not eligible to participate in wager-based games. An eligibility or compliance determination can also be made with respect to a known player as well, such as where a player might be a minor or other person who should not be wagering. Further details and embodiments regarding compliance checking and eligibility determinations can be found at, for example, U.S. Pat. No. 8,727,892.

Master game server 822 can also provide confirmation to the gaming terminals that wagers were or were not accepted, and can also create a transaction record for each accepted wager. A copy of the transaction record can be kept at the master game server 822 and/or an associated database, and a copy can also be sent to the gaming terminal that placed the wager. These recorded transaction records can include information such as, for example, gaming terminal ID, player ID, casino ID, gaming table ID, game number, time, game outcome, wager amount, win/loss, account balance, and the like. The master game server 822 can also have the game logic for all games, and can receive all raw data from all gaming tables. As such, the master game server can be responsible for recording all game outcomes, resolving all wagers and awards, and communicating these outcomes and awards to the gaming terminals and databases.

In addition to the foregoing functions, the master game server 822 can also schedule or otherwise control the start time and/or game pace for the various table games administered across the system gaming tables. Again, this can be done to stagger the start times such that games are spread out and starting in a sequential and somewhat regular basis, such as to allow for greater and more flexible game play as desired by some players. This game start time control function can be accomplished by way of sending a signal to every gaming table as to when the next game is allowed to start at that table. Where a given gaming table is fully automated, the next game will then automatically start at the designated time signaled to the table by the master game server 822. Where a live human dealer is administering games at a given gaming table, however, then the signal sent can indicate to the dealer the actual time when he or she should start dealing cards, shaking dice, spinning the wheel, or performing some other physical function that indicates the start of actual game play. This signal can be by way of one or more indication lights, a timer, a countdown, or some other indicator to facilitate a proper start time to the next game play, as instructed by the master game server 822.

By scheduling and controlling game start times in this manner, the master game server 822 can control not only when the next game starts, but on which gaming table it starts as well. The master game server 822 can thus also be responsible for queueing gaming tables, such that preferred tables may see more use, or some tables can be rested or put out of use during slow times. In some embodiments, the master game server 822 can be configured to control gaming table usage such that each gaming table experiences about the same amount of usage. In various arrangements, gaming tables can be queued for next game signals on a first-in-first-out basis, or gaming tables can be queued on a first-in-last-out basis, such that some tables see little use except during the most busy periods. In various embodiments using the master game server 822 or another system server in this context, scheduling a given gaming table can be considered to move that gaming table into a queue to have a game played at the table, while controlling a start time on a gaming table can be considered to facilitate a controlled start of the game.

Game start times can be controlled at the master game server 822 in several ways. In some arrangements, the start times can be spaced apart such that there is about the same amount of time between all games. Start times can be set well in advance for each table and even each game. Alternatively, start times can depend upon the start times of the previous or other recently started games. For example, a setting can require that a minimum amount of time elapses from when the last game started before the next game can start. This minimum amount of time can be on the order of 1 or 2 seconds, such as where there are many gaming tables in a system, or can be about 10, 15, 20, or even 30 seconds, such as in the case of only a few gaming tables. In this manner, consecutive games will not start too close together. As another example, a setting can allow for a maximum amount of time to elapse between consecutive start times. In this manner there cannot be too much time before the next game will start at one of the system gaming tables. Such a maximum time can be on the order of 15 to 30 seconds in some arrangements, and may even be less where there are many tables in a system.

Alternatively, or in addition to set times and relative time spacing between game start times, other factors can contribute to when a next game is permitted to start and/or when a signal gets sent from a system server to a gaming table with a start time for its next game. For example, a triggering event detected at the server can cause a start time to be set or a start time signal to be sent to a gaming table. Such triggering events can include, for example, the placement of a wager by a player, the placement of multiple wagers, a determination that there are too few gaming tables in active service (e.g., 3 or less), a determination that there are too many players that are active for the number of tables in service, and so forth.

Figures 9A, 9B:
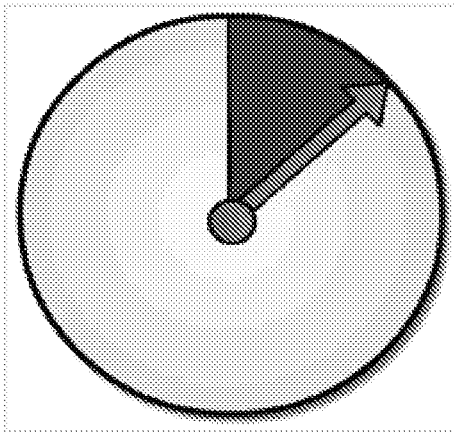
FIG. 9A illustrates an exemplary graphical representation of a wager countdown clock according to various embodiments of the present disclosure.
FIG. 9B illustrates an exemplary graphical representation of a table game results history display according to various embodiments of the present disclosure.

FIG. 9A illustrates an exemplary graphical representation of a wager countdown clock according to various embodiments of the present disclosure. Wager countdown clock 900 can be a dynamic graphic representation that indicates to a player how much time is left before no more wagers will be taken for the next play of a game at a respective gaming table. As such, a separate wager countdown clock 900 can be included on each display representing an active gaming table. For example, each of the small displays 711-715 in screenshot 700 above can include its own separate wager countdown clock 900, such as in a corner of the small display. A larger wager countdown clock 900 might be included in a more prominent location for the main display 720 in screenshot 700.

A typical wager countdown clock 900 can represent a set amount of time when it is full, which represents the entire window during which wagers can be placed on the next game at a respective gaming table. This wager placement window can be any amount desired by a given operator, such as, for example, about 20 or 30 seconds. The wager countdown clock 900 can then steadily count down until it is empty, such as by a rotation of a clock hand, as shown. A first color can represent the time that is left, while a second color can represent the time that has already passed in the current wager placement window. Of course, other times, designs, and graphical representations may also be used for this function, as will be readily appreciated.

FIG. 9B illustrates an exemplary graphical representation of a table game results history display according to various embodiments of the present disclosure. Roadmap 950 can represent in table form the recent histories for multiple gaming tables, such as, for example, three different roulette tables. This can be presented to the user in a manner similar to that which is presented for roadmap 730 above for a baccarat table, for example. In addition, or alternatively, one or more roadmaps can be presented as a standalone display, such that many players and other bystanders can view and study the roadmap(s) separately from any other table display.

In addition to the wager countdown clock and table game results history or roadmap set forth above, there can be additional features that may be specific to a given gaming table or set of gaming tables. For example, each separate gaming table can still maintain its own separate accounting meters. This can be particularly useful where an overall gaming table system offers multiple gaming tables from different jurisdictions or rule sets. With separate meters at each table, differences that may exist for different gaming tables can be tracked more readily, such as with respect to different tax rates, bet limits, time limits, promotions, laws, rule sets, and the like. In addition to separate and individual accounting meters, one or more global meters can also be used. Such global meters can track all wagers for a given table, for a given gaming terminal, for a given casino or time period, and so forth.

Figure 10:
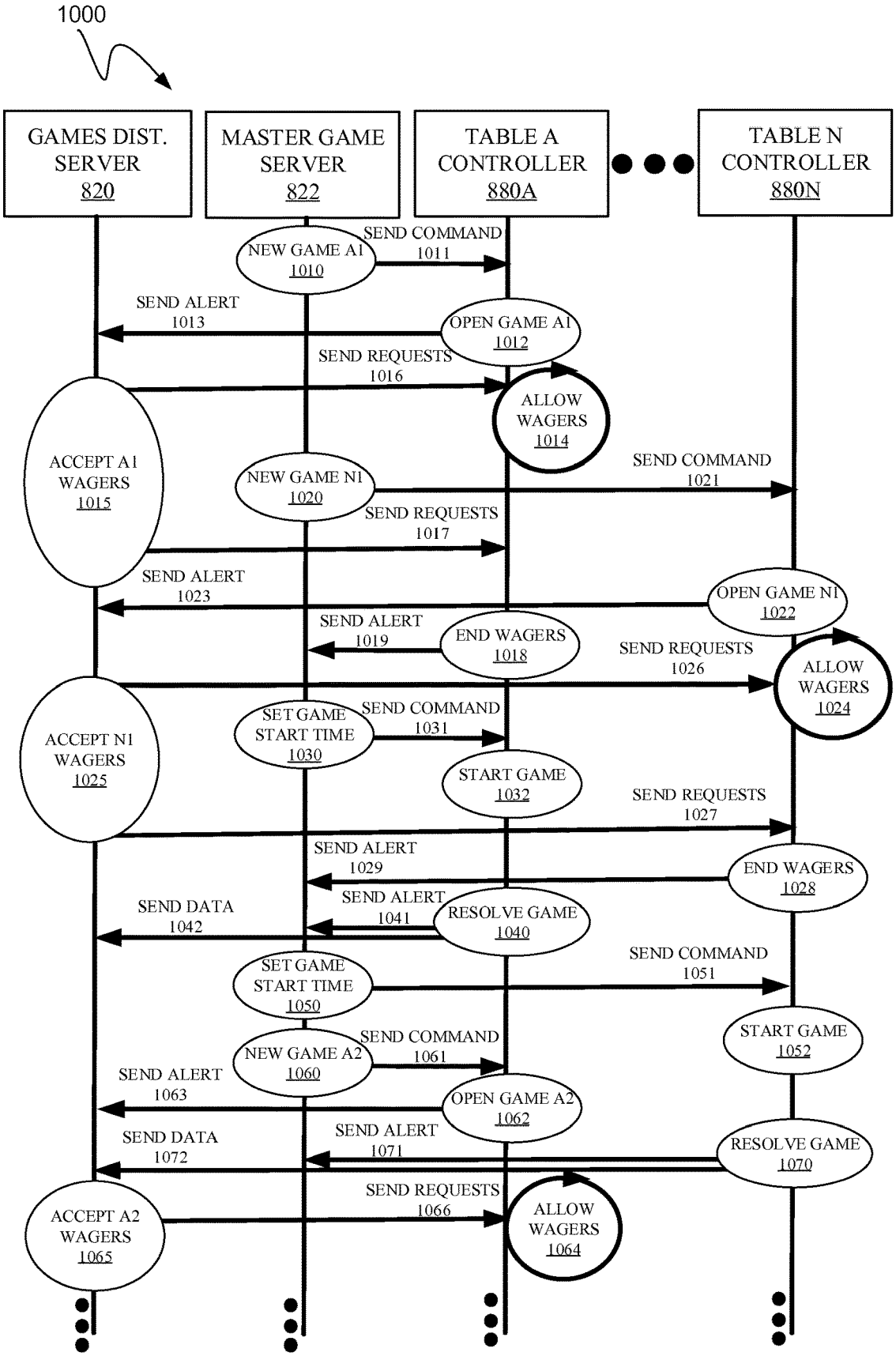
FIG. 10 illustrates a sequence diagram for an exemplary system server administered process of controlling starting times for wager-based table games across multiple system gaming tables according to various embodiments of the present disclosure.

FIG. 10 illustrates a sequence diagram for an exemplary system server administered process of controlling starting times for wager-based table games across multiple system gaming tables according to various embodiments of the present disclosure. Sequence diagram 1000 can involve various events, items, and stages that take place between multiple system components. The system components can include, for example, a games distribution server 820, a master game server 822, and a plurality of table game controllers 880A through 880N. Other system items may also be included, but are not shown here for purposes of simplicity.

At a first sequence event 1010, a generation of a new table game "A1" is ordered by the master game server 822. A command 1011 is sent from the master game server 822 to the table or peripheral controller 880A for gaming table 802A, upon which the controller opens up a new game A1 at the gaming table at sequence event 1012. Upon opening up the new game A1, the table controller 880A sends an alert 1013 to the games distribution server 820 to let the system know that a new game A1 is available to be wagered upon, and the table controller 880A then goes into an allow wager mode 1014. The games distribution server 820 can then accept wagers on the new game A1 from gaming terminals (not shown) at sequence event 1015, and can forward these along as wager requests 1016 and over time wager requests 1017. Although not specifically shown, these wager requests 1016, 1017 can be sent through the master game server 822, such as where the master game server can verify, confirm, and/or create transaction records for the placed wagers.

At a following sequence event 1020, and while wagers are still being accepted and allowed on game A1, a generation of another new table game "N1" is ordered by the master game server 822. The subsequent commands, events, alerts, and the like stemming from sequence event 1020 can be substantially similar to that which followed the first sequence event 1010, only these take place at and concern new game N1 controlled by table or peripheral controller 880N at gaming table 802N. This identical or similar process can be repeated for any number new table games A1 through N1 on respective gaming tables 802A through 802N, as will be readily appreciated.

For purposes of illustration for new game N1, a command 1021 is sent from the master game server 822 to the table controller 880N for gaming table 802N, upon which the controller opens up the new game N1 at the gaming table at sequence event 1022. Upon opening up the new game N1, the table controller 880N sends an alert 1023 to the games distribution server 820 to let the system know that a new game N1 is available to be wagered upon, and the table controller 880N then goes into an allow wager mode 1024. The games distribution server 820 can then accept wagers on the new game N1 at sequence event 1025, and can forward these along as wager requests 1026 and over time wager requests 1027, which again can be sent through the master game server 822. At or about the same time, sequence event 1018 at table controller 880A results in the wager time window closing or ending for game A1, upon which an alert 1019 can be sent to the master game server 822 from the table controller 880A.

At the next sequence event 1030, the master game server 822 sets a game start time for game A1, and sends a signal or command 1031 reflecting this start time to table controller 880A. Again, this can take place while the games distribution server 820 is still accepting wagers for game N1, such that the games A1 and N1 do not take place at the exact same time, but are effectively overlapping. At the next sequence event 1032, table controller 880A can facilitate the start of game A1 at gaming table 802A. At or about the same time during game play for game A1, sequence event 1028 at table controller 880N results in the wager time window closing or ending for game N1, upon which an alert 1029 can be sent to the master game server 822 from the respective table controller 880N.

At sequence event 1040, game A1 is resolved at table controller 880A, upon which an alert 1041 and/or game data 1042 can be sent to both of the master game server 822 and the games distribution server 820 regarding resolved game A1.

At sequence event 1050, which can occur at or about the same time as sequence event 1040 depending upon the length of the game play, the master game server 822 sets a game start time for game N1, and sends a signal or command 1051 reflecting this start time to table controller 880N. At the next sequence event 1052, table controller 880N can facilitate the start of game N1 at gaming table 802N. As in the case of game A1 above, such a game start facilitation can be fully automated, or can be in the form of a signal provided to a live human dealer as to when to start the game N1. At or about the same time during game play for game N1, the next sequence event 1060 can take place.

At sequence event 1060, master game server 822 can come full cycle for the first gaming table 802A and order generation of another new game "A2." This can involve a similar command 1061 sent from the master game server 822 to table controller 880A for gaming table 802A, upon which the controller opens up a new game A2 at the gaming table at sequence event 1062. Upon opening up the new game A2, the table controller 880A again sends an alert 1063 to the games distribution server 820 to let the system know that a new game A2 is available to be wagered upon, and the table controller 880A then goes into an allow wager mode 1064. The games distribution server 820 can then accept wagers on the new game A2 at sequence event 1065, and can forward these along as wager requests 1066, and so on.

At or about the same time at sequence event 1070, game N1 is resolved at table controller 880N, upon which an alert 1071 and/or game data 1072 can be sent to both of the master game server 822 and the games distribution server 820 regarding resolved game N1. As shown by the ellipses at the bottom of each sequence line, this entire process can then repeat indefinitely for ongoing new table games at gaming tables 802A and 802N, with the timing of the games at these tables being offset and overlapping. Again, multiple further gaming tables can also experience the same events, commands, alerts, and steps for new table games at those gaming tables as well, with the cycle at each additional gaming table similarly being offset in time and overlapping with the cycle of every other gaming table in the sequence.

Figure 11:
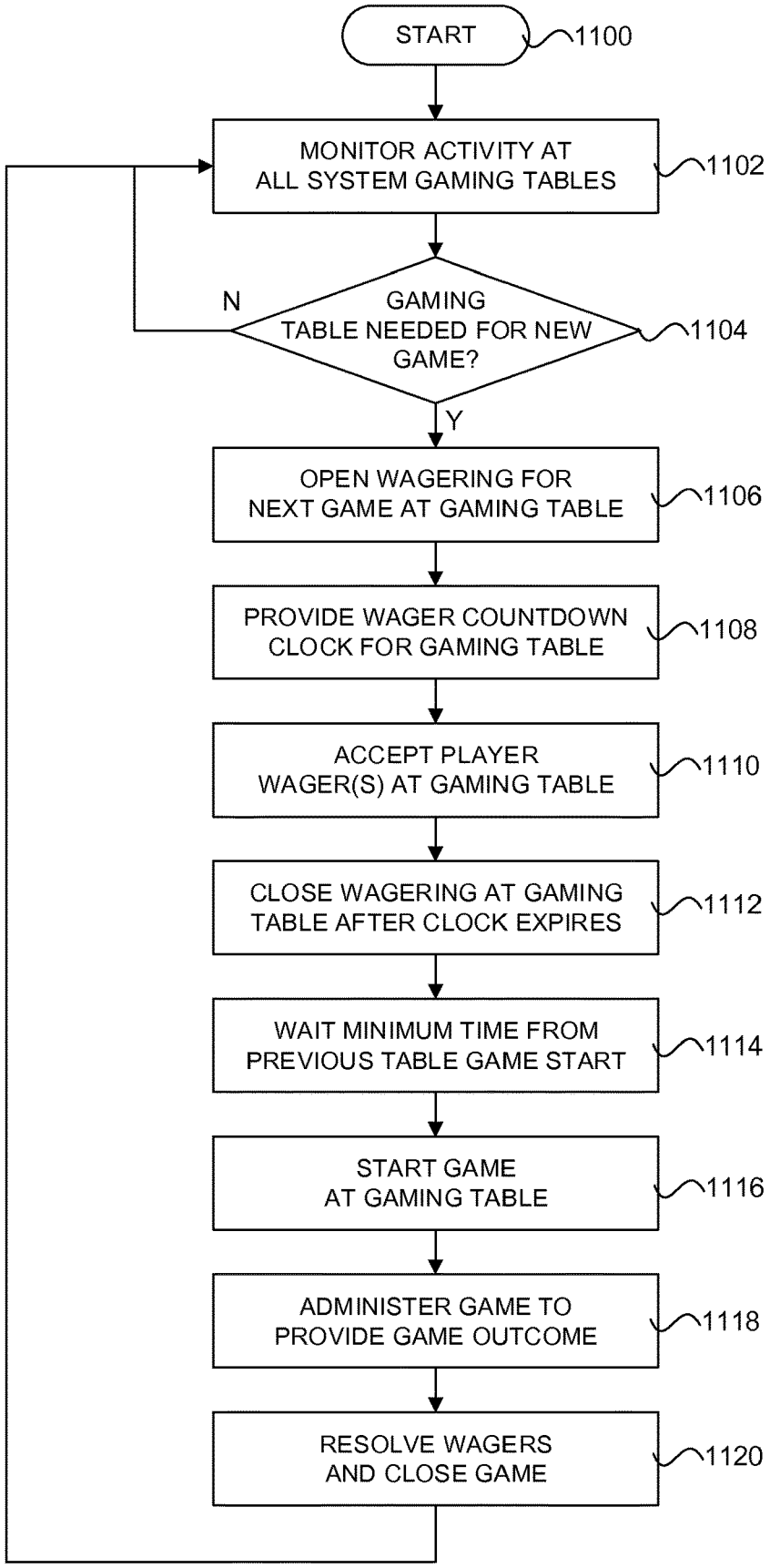
FIG. 11 illustrates a flowchart of an exemplary method performed by a system server for staggering the play of wager-based table games across many physical electronic gaming tables according to various embodiments of the present disclosure.

FIG. 11 illustrates a flowchart of an exemplary method performed by a system server for staggering the play of wager-based table games across multiple physical electronic gaming tables according to various embodiments of the present disclosure. In various embodiments, the method can be performed by a processor at a system server, such as a master game server. In particular, the method shown is provided with respect to a single instance of use for one system gaming table. As shown, the method can be repeated for multiple uses at the same gaming table. Further, the master game server can perform this method simultaneously for each separate gaming table across the gaming table system. After a start step 1100, an initial process step 1102 can involve monitoring activity at all system gaming tables. Again, this is a step that can be constantly performed by the master game server or other system server, or can be a step that is performed upon a given trigger.

At a subsequent decision step 1104, an inquiry can be made as to whether the subject gaming table is needed to provide a new game for the overall gaming table system. If not, then the method reverts to process step 1102 where activity is still monitored. If a new game is needed at the gaming table, however, then the method continues to process step 1106, where a new game is generated and a wagering time window is opened for the new game at the gaming table. At the next process step 1108, a wager countdown clock for the gaming table can be provided or otherwise displayed. One or more player wagers can then be accepted at the gaming table at the next process step 1110.

At a following process step 1112, the wagering time window or period is closed after the wager countdown clock expires. A wait is then observed for a minimum amount of time from the start time of the previous table game at process step 1114, after which the new game is started at the gaming table at process step 1116. This wait time corresponds to the start time for the new game as controlled and set by the system server. This can be in the form of a signal sent from the system server to the gaming table where the new game is to be played. This signal setting the start time can be sent as part of the new game and open wagering process step 1106, or the signal can be sent as part of the wait time process step 1114. At a next process step 1118, the game can then be played or administered at the gaming table to provide a game outcome. At a following process step 1120, the pending wagers can be resolved and the game can be closed.

The method can then revert to process step 1102 to repeat for the next time the gaming table is needed to provide a new table game for the gaming table system. Alternatively, the current game can end and a subsequent table game at that gaming table can commence immediately or shortly thereafter, such as where the system detects that no new table game has started within a previous set time period. For example, if no new table game across the system has started within the last 15 seconds, then a subsequent table game can start without delay. This time period can be shortened or lengthened as desired, such as to 5 or 30 seconds, for example. Again, by having a minimum wait period between consecutive games across the table game system, this prevents the simultaneous or close together start of different games at different tables. Also, by allowing the gaming table to start a new game immediately without reverting to a wait or delay period if no game has started across the whole system recently, this prevents the introduction of too much time between start times of consecutive games. Either way, the overall objective of providing a continuous availability of newly starting games that do not start at the exact same time is achieved.

In various embodiments, the master game server or another system server can be configured in its scheduling and controlling operations to control the start times such that any wait time is dynamically adjusted according to ongoing game conditions and situations. That is, the wait time for any given game start can be dynamically lengthened or shortened according to the varying game lengths and start times of other games, such that the time spacing between game starts is substantially equalized across many or all game starts. This time spacing optimization can allow for a relatively continuous and predictable availability of new games over time, which can be an advantageous feature that is attractive to many players.

Figure 12:
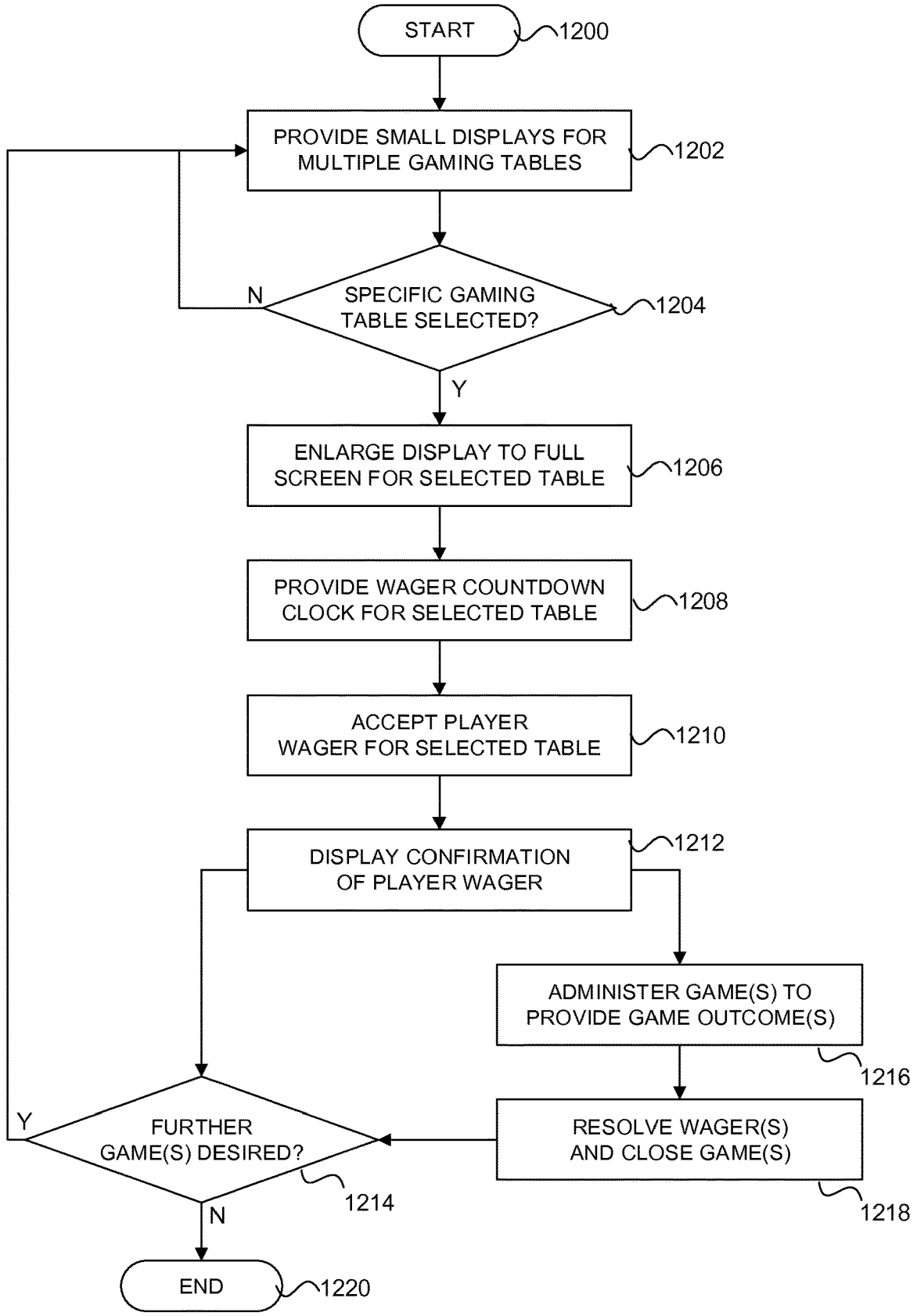
FIG. 12 illustrates a flowchart of an exemplary method performed by a gaming terminal processor for facilitating at the gaming terminal the simultaneous play of multiple wager-based table games at multiple physical electronic gaming tables according to various embodiments of the present disclosure.

FIG. 12 illustrates a flowchart of an exemplary method performed by a gaming terminal processor for facilitating at the gaming terminal the simultaneous play of multiple wager-based table games at multiple physical electronic gaming tables according to various embodiments of the present disclosure. After a start step 1200, an initial process step 1202 can involve providing individual and separate small displays for multiple gaming tables. This can resemble the small displays 711-715 depicted above, for example.

At a subsequent decision step 1204, an inquiry can be made as to whether a specific gaming table has been selected at the gaming terminal. This can be made by way of a player or user input, for example. If not, then the method reverts to process step 1202 where the small displays for all of the actively monitored tables are still provided. Where a user input selecting a specific gaming table is detected, however, then the method moves to process step 1206, where the display for the selected gaming table is enlarged or otherwise emphasized. Other ways of emphasizing a selected gaming table can include highlighting, a bezel, brighter colors, and the like. At the next process step 1208, a wager countdown clock can be displayed for the selected gaming table. Again, such a clock or timer can provide the user or player with an indication of how much time is left before wagers will no longer be accepted for the next game play at the selected gaming table.

At the following process step 1210, a player wager for the selected gaming table can be accepted. A confirmation of the accepted player wager can then be displayed back to the player at the next process step 1212. At this point, the method can continue along parallel paths. An inquiry can be made as to whether further games are desired at decision step 1214. If further games are desired, then the process from steps 1202 through 1212 can be repeated for another game at another selected gaming table. At the same time, the method can also continue to process step 1216 at the first selected gaming table, where the first game wagered on is administered to provide a game outcome. The wager is resolved and the game is then closed at the next process step 1218, after which the method moves over to decision step 1214 to determine whether still further games are desired.

Given the parallel processing at steps 1214 back through 1212, and also steps 1216 and 1218 at the same time, a given player can have one, two, or many games pending at the same time in the administer and resolve steps 1216 and 1218. It can be up to the player how many games are being wagered on, played, and resolved simultaneously. This process can continue and repeat as often as desired, until no further games are desired. If no further games are desired at decision step 1214, then the method ends at end step 1220.

Again, the device functioning as a gaming terminal can be a third party device, such as that which is owned by the player or associate, or can be a device that is owned or operated by the casino or other host establishment. Such a device can be a portable device, or any other suitable electronic device. Suitable modules, apps, programs, and/or other components can be used to facilitate such use, which can include verification and debiting capabilities with respect to a player balance on his or her separate third party device.

For the foregoing flowcharts and methods, it will be readily appreciated that not every method step provided is always necessary, and that further steps not set forth herein may also be included. For example, added steps may involve code generation, error detection, and alert provisions. Also, further steps to involve player tracking and recordation of data may be added. Furthermore, the exact order of steps may be altered as desired, and some steps may be performed simultaneously.

It should be understood that the devices, systems and methods described herein may be adapted and configured to function independently or may also interact with other systems or applications, such as for example, a casino management system or player tracking system. It should also be readily apparent that additional computerized or manual systems may also be employed in accordance with the disclosure in order to achieve its full implementation as a system, apparatus or method.

Those skilled in the art will readily appreciate that any of the systems and methods of the disclosure may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as an existing electronic gaming machine, portable computing device or electronic platforms with multiple player positions. In addition, the system of the disclosure may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the disclosure so long as players and operators thereof are provided with useful access thereto or the opportunity to play the game as described herein.

The various aspects, embodiments, implementations or features of the described embodiments can be used separately or in any combination. Various aspects of the described embodiments can be implemented by software, hardware or a combination of hardware and software. Computer readable medium can be any data storage device that can store data which can thereafter be read by a computer system. Examples of computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A gaming table system, comprising:

a plurality of electronic gaming tables that provide wager-based table games, each of the plurality of electronic gaming tables including a table controller adapted to control electronic gaming table functions and a table communication interface coupled to the table controller and adapted to facilitate communications between the table controller and one or more other gaming table system components;

a plurality of gaming terminals, each of the plurality of gaming terminals including a terminal controller adapted to facilitate the simultaneous play by a single player of multiple wager-based table games at multiple of the plurality of electronic gaming tables, one or more display components coupled to the terminal controller and adapted to provide output to the single player regarding the simultaneous play of the multiple wager-based table games, and a terminal communication interface coupled to the terminal controller and adapted to facilitate communications between the terminal controller and one or more other gaming table system components; and a first system server in communication with the plurality of electronic gaming tables, wherein the first system server monitors triggering events associated with the plurality of electronic gaming tables and controls starting times of at least some of the wager-based table games played on the plurality of electronic gaming tables such that the starting times of the at least some of the wager-based table games are controlled based at least in part on at least one of the triggering events, wherein the first server system is configured to send a start time command to one or more of the plurality of electronic gaming tables to thereby control the starting time of the at least some of the wager-based table games, and wherein the relative start times of the wager-based table games played on the plurality of electronic gaming tables are controllably staggered.

2. The gaming table system of claim 1, wherein the start time command denotes a particular start time.

3. The gaming table system of claim 1, wherein the start time command denotes a start time after a delay.

4. The gaming table system of claim 1, wherein at least one of the plurality of electronic gaming tables includes a physical surface for administration of at least one of the wager-based table games by a live dealer that physically interacts with physical gaming objects via the physical surface, whereby the at least one of the wager-based table games by the live dealer is a wager-based table game.

5. The gaming table system of claim 1, wherein the triggering event for at least one of the wager-based table games is dependent on at least one wager being placed by a player of the at least one of the wager-based table games.

6. An electronic gaming table system, comprising:

a first system server in communication with a plurality of electronic gaming tables, each of the plurality of electronic gaming tables providing wager-based table games that are playable from a plurality of gaming terminals that are each adapted for the simultaneous play of multiple wager-based table games at multiple of the plurality of electronic gaming tables, wherein the first system server monitors triggering events associated with the plurality of electronic gaming tables and controls starting times of new wager-based table games on at least some of the plurality of electronic gaming tables, wherein the first system server transmits a start time command to at least some of the wager-based table games to control the starting times of the at least some of the wager-based table games based at least in part on at least one of the triggering events; and a second system server that facilitates tracking players of the multiple wager-based table games, the second server system storing (i) data associated with game play by players and (ii) data associated with performance of the plurality of electronic gaming tables.

7. The electronic gaming table system of claim 6, wherein the first system server controls the starting times by sending signals to the plurality of electronic gaming tables indicating when new wager-based table games are allowed to start.

8. The electronic gaming table system of claim 6, wherein the first system server staggers the starting times of the new wager-based table games.

9. The electronic gaming table system of claim 6, wherein at least one of the plurality of electronic gaming tables includes a physical surface for administration of at least one of the wager-based table games by a live dealer that physically interacts with physical gaming objects via the physical surface, whereby the at least one of the wager-based table games by the live dealer is a wager-based table game.

10. The electronic gaming table system of claim 6, wherein the at least one of the triggering events is dependent on at least one wager being placed by a player of the at least one of the wager-based table games.

11. A method performed by a gaming terminal processor for facilitating at the gaming terminal the simultaneous play of multiple wager-based table games at multiple physical electronic gaming tables, the method comprising:

providing simultaneously small displays for each of a plurality of electronic gaming tables hosting live wager-based table games;

detecting a first user input indicating a first selected electronic gaming table from the plurality of electronic gaming tables;

emphasizing the display for the first selected electronic gaming table;

displaying a wager countdown clock for the first selected electronic gaming table;

accepting a first wager on a first game play at the first selected electronic gaming table;

detecting a second user input indicating a second selected electronic gaming table from the plurality of electronic gaming tables;

accepting a second wager on a second game play at the second selected electronic gaming table;

administering both of the first game play and second game play after accepting both of the first wager and the second wager, the administering including at least monitoring for event conditions and controlling, based at least in part on the event conditions, start times of the first game play at the first selected electronic gaming device and the second game play at the second selected electronic gaming device; and resolving the first wager according to the outcome of the first game play, wherein the administering of the start times is configured to send a start time command to one or both of the first game play at the first selected electronic gaming device and the second game play at the second selected electronic gaming device to thereby control the starting time of the one or both of the first game play at the first selected electronic gaming device and the second game play at the second selected electronic gaming device.

12. The method of claim 11, wherein the start time command denotes a particular start time.

13. The method of claim 11, wherein the start time command denotes a start time after a delay relative to the first start time.

14. The method of claim 11, wherein at least one of the plurality of electronic gaming tables includes a physical surface for administration of at least one of the wager-based table games by a live dealer that physically interacts with physical gaming objects via the physical surface to conduct one or more wager-based table games.

* * * * *